US009403132B2

(12) United States Patent
Hata

(10) Patent No.: US 9,403,132 B2
(45) Date of Patent: Aug. 2, 2016

(54) FLUID MIXER AND FLUID MIXING METHOD

(75) Inventor: Takashi Hata, Nankoku (JP)

(73) Assignee: KOCHI NATIONAL COLLEGE OF TECHNOLOGY, JAPAN, Tokyo (JP)

( * ) Notice: Subject to any disclaimer, the term of this patent is extended or adjusted under 35 U.S.C. 154(b) by 506 days.

(21) Appl. No.: 13/995,731

(22) PCT Filed: Dec. 21, 2011

(86) PCT No.: PCT/JP2011/079637
§ 371 (c)(1),
(2), (4) Date: Jul. 16, 2013

(87) PCT Pub. No.: WO2012/086685
PCT Pub. Date: Jun. 28, 2012

(65) Prior Publication Data

US 2014/0313849 A1 Oct. 23, 2014

(30) Foreign Application Priority Data

Dec. 22, 2010 (JP) ..... 2010-285833
Jul. 29, 2011 (JP) ..... 2011-167100

(51) Int. Cl.
*B01F 5/06* (2006.01)
*B01F 3/08* (2006.01)
(Continued)

(52) U.S. Cl.
CPC ..... *B01F 5/06* (2013.01); *B01F 3/0807* (2013.01); *B01F 5/0062* (2013.01);
(Continued)

(58) Field of Classification Search
CPC ..... B01F 5/0057; B01F 5/0068; B01F 2005/002; B01F 13/0066; B01F 5/048; B01F 2005/0017; B01F 2005/0022; B01F 5/0656; B01F 5/0659; B01F 5/043; B01F 15/0258; B01F 3/0807; B01F 5/0062; B01F 5/0485; B01F 5/06
See application file for complete search history.

(56) References Cited

U.S. PATENT DOCUMENTS 1,451,063 A * 4/1923 Anthony ..... F23D 11/10 239/404
1,496,345 A * 6/1924 Lichtenthaeler ..... B01F 5/0451 366/147

(Continued)

FOREIGN PATENT DOCUMENTS

JP 57-012821 1/1982
JP 01-094931 4/1989

(Continued)

OTHER PUBLICATIONS

International Search Report, PCT Appln. Serial No. PCT/JP2011/079637 mailed Jan. 24, 2012, 3 pages—Japanese; 2 pages—English.

*Primary Examiner* — Tony G Soohoo
(74) *Attorney, Agent, or Firm* — Andrew F. Young, Esq.; Lackenbach Siegel, LLP

(57) ABSTRACT

A cylindrical mixer having an opening portion on both ends forms an axial flow path and a first fluid introduced into the axial flow path through the opening portion at one end flows therethrough in the axial direction and the first fluid exits from the opening portion at the other end; and a spiral flow path and a second fluid introduced into the spiral flow path through a hole formed in a peripheral wall of the mixer is made to flow along an inner peripheral surface of the mixer while being swirled in a spiral manner about an axis of the axial flow path so that the first fluid and the second fluid are mixed and a mixture of the first fluid and the second fluid exits from an opening potion at the end to refine and homogenize a dispersion phase on a micro level to a sub-micro level.

9 Claims, 18 Drawing Sheets

(51) Int. Cl.
*B01F 15/02* (2006.01)
*B01F 5/00* (2006.01)
*B01F 5/04* (2006.01)

(52) U.S. Cl.
CPC ..... *B01F 5/0485* (2013.01); *B01F 15/0258* (2013.01); *B01F 5/0057* (2013.01); *B01F 5/0068* (2013.01); *B01F 5/043* (2013.01); *B01F 5/048* (2013.01); *B01F 5/0656* (2013.01); *B01F 5/0659* (2013.01); *B01F 2005/002* (2013.01); *B01F 2005/0017* (2013.01); *B01F 2005/0022* (2013.01)

(56) References Cited

U.S. PATENT DOCUMENTS 1,626,487 A * 4/1927 Warren ..... B01F 5/0405 137/889
1,698,432 A * 1/1929 Erickson ..... B01F 5/0659 196/46
2,784,948 A * 3/1957 Pahl ..... B01F 5/0451 198/657
2,831,754 A * 4/1958 Manka ..... B01D 11/0473 239/404
2,886,297 A * 5/1959 Ralph ..... B01F 5/0057 159/13.4
2,935,840 A * 5/1960 Schoppe ..... F23R 3/58 261/79.2
3,081,818 A * 3/1963 Braconier ..... B01F 3/02 431/346
3,105,778 A * 10/1963 Anderson ..... B01F 5/0068 127/28
3,190,618 A * 6/1965 Katzen ..... B01F 5/0619 366/337
3,251,653 A * 5/1966 Aditya ..... B01J 12/00 366/165.1
3,332,442 A * 7/1967 Reed ..... B01F 5/045 137/896
3,794,299 A * 2/1974 Wagner ..... B01F 5/0057 210/198.1
3,818,938 A * 6/1974 Carson ..... B01F 5/0405 239/427.5
3,847,375 A * 11/1974 Kuerten ..... B01F 5/0212 366/101
3,866,886 A * 2/1975 Thorne ..... B01F 5/045 366/159.1
4,019,720 A * 4/1977 Levesque ..... B01F 5/0068 261/124
4,043,539 A * 8/1977 Gilmer ..... B01F 5/0659 138/42
4,053,142 A * 10/1977 Johannes ..... B01F 5/0068 366/165.1
4,095,847 A * 6/1978 Wear ..... B65G 53/14 406/85
4,108,732 A * 8/1978 Nuttall, Jr. ..... B01F 5/0057 201/13
4,111,402 A * 9/1978 Barbini ..... B01F 3/10 138/38
4,218,012 A * 8/1980 Hamza ..... B01F 1/0022 239/10
4,390,284 A * 6/1983 Hyde ..... B01D 47/06 118/303
4,464,314 A * 8/1984 Surovikin ..... B01F 5/0057 239/400
4,474,477 A * 10/1984 Smith ..... B01F 5/0485 261/118
4,498,819 A * 2/1985 El-Saie ..... B01F 5/0057 137/896
4,512,935 A * 4/1985 Hilmersson ..... A61L 2/20 261/115
5,060,867 A * 10/1991 Luxton ..... B01F 5/0415 239/428.5
5,705,060 A * 1/1998 Robberts ..... B01F 5/0057 210/198.1
5,865,537 A * 2/1999 Streiff ..... B01F 3/10 366/137
6,027,241 A * 2/2000 King ..... B01F 3/0873 138/38
6,074,085 A * 6/2000 Scarpa ..... B01F 5/0057 366/101
6,102,561 A * 8/2000 King ..... B01F 5/0614 138/38
6,382,601 B1 * 5/2002 Ohnari ..... B01F 3/0446 261/123
6,450,344 B1 9/2002 Kitano et al.
6,659,636 B1 * 12/2003 Matula ..... B01F 3/0865 366/165.1
7,416,404 B2 * 8/2008 Chan ..... B01F 5/0453 239/403
7,622,036 B2 * 11/2009 Morse ..... B01F 3/0446 210/101
8,376,053 B2 * 2/2013 Obrejanu ..... E21B 17/00 166/242.3
2005/0002270 A1 * 1/2005 Bergman ..... B01F 5/0057 366/165.2
2008/0197516 A1 * 8/2008 Abe ..... A01K 63/042 261/75
2008/0267006 A1 * 10/2008 Moreira Campos .. B01F 3/0446 366/165.1
2009/0034361 A1 * 2/2009 Trang ..... B01F 3/0865 366/152.1
2009/0152381 A1 6/2009 Kikuchi
2009/0201760 A1 * 8/2009 Vorage ..... B01F 3/0861 366/163.1
2009/0201761 A1 8/2009 Matsuno et al.
2012/0126436 A1 * 5/2012 Hato ..... A01K 63/042 261/36.1

FOREIGN PATENT DOCUMENTS

JP 2000140708 5/2000
JP 2003275554 9/2003
JP 2009142750 7/2009
JP 2009279507 12/2009
JP 2010090233 4/2010
WO WO 2008/038763 4/2008
WO WO 2012086685 A1 * 6/2012 ..... B01F 3/0807

* cited by examiner

Fig. 27

| AMOUNT OF PRODUCED EMULSION (TOTAL FLOW RATE) | INTRODUCING AMOUNT OF OLEIC ACID | | | |
|---|---|---|---|---|
| | 140 mℓ/min | 130 mℓ/min | 100 mℓ/min | 50 mℓ/min |
| 16 ℓ/min | — | $45\times10^6$ /mℓ | $38\times10^6$ /mℓ | $33\times10^6$ /mℓ |
| 23 ℓ/min | $43\times10^6$ /mℓ | — | $33\times10^6$ /mℓ | $7\times10^6$ /mℓ |

TOTAL NUMBER OF PARTICLES HAVING PARTICLE SIZE OF 3 μm OR LESS

Fig. 28

| KINDS OF OIL | VISCOSITY (15℃) mPa·S | AVERAGE PARTICLE SIZE | TOTAL NUMBER OF PARTICLES HAVING PARTICLE SIZE OF 3 μm OR LESS |
|---|---|---|---|
| SOYBEAN OIL | 84.0 | 1.3 | $86\times10^5$ |
| RAPESEED OIL | 99.5 | 1.6 | $75\times10^5$ |
| CORN OIL | 88.7 | 1.4 | $77\times10^5$ |
| OLIVE OIL | 110.0 | 1.2 | $61\times10^5$ |
| CAMELLIA OIL | 115.0 | 1.3 | $81\times10^5$ |

FLUID MIXER AND FLUID MIXING METHOD

CROSS REFERENCE TO RELATED APPLICATIONS

This application relates to and claims priority from International Application Ser. No. PCT/JP2011/079637 filed Dec. 21, 2011, the entire contents of which are incorporated herein by reference which in turn claims priority from JP Ser. No. 2011-167100 filed Jul. 29, 2011 and JP Ser. No. 2010-285833 filed Dec. 22, 2010.

TECHNICAL FIELD

The present invention relates to a fluid mixer and a fluid mixing method for mixing plural kinds of fluids. Here, fluid means liquid or gas. Fluid may also mean a liquid-liquid mixture, a liquid-gas mixture or a gas-gas mixture. Particularly, the present invention can refine and homogenize a dispersion phase of emulsion. Emulsion means a disperse system solution where both a dispersoid and a dispersion medium are in a liquid form.

BACKGROUND ART

Conventionally, as one mode of a fluid mixer, there has been known an emulsifying apparatus disclosed in patent literature 1. Such an emulsifying apparatus is configured as follows. To a dispersion phase flow path which extends linearly, a pair of continuous phase flow paths which extends in the direction orthogonal to the dispersion phase flow path is connected by way of a swirl flow path which swirls around an axis of the dispersion phase flow path and thereby a mixing flow path is formed coaxially with the dispersion phase flow path and downstream of the swirl flow path.

Due to such a constitution, a dispersion phase supplied through the dispersion phase flow path and a continuous phase supplied through the continuous phase flow path merge through the swirl flow path, and these phases are mixed with each other through the mixing flow path thus forming emulsion.

CITATION LIST

Patent Literature

PTL 1: JP-A-2009-279507

SUMMARY OF INVENTION

Technical Problem

However, the above-mentioned emulsifying apparatus is constituted by laminating a liquid introducing portion, a merged flow path portion, a mixing flow path portion and a liquid exit portion all of which have a plate shape. The flow path forming passages which are formed in the respective portions are connected with each other thus forming a dispersion phase flow path, a continuous phase flow path, a swirl flow path and a mixing flow path. In this manner, the structure is complicated and it is cumbersome to form the respective flow path forming passages. Accordingly, a manufacturing cost of the emulsifying apparatus is expensive, and a dispersion phase cannot be refined at a sub-micro level.

Accordingly, it is an object of the present invention to provide a fluid mixer and a fluid mixing method which can refine and homogenize a dispersion phase at a micro level or a sub-micro level at a low cost with the simple structure.

Solution to Problem

A fluid mixer according to the invention described in claim 1 is characterized in that a cylindrical mixer body having an opening portion on both ends thereof forms therein: an axial flow path in which a first fluid introduced into the axial flow path through the opening portion at one end is made to flow therethrough in the axial direction and the first fluid is made to exit from the opening portion at the other end; and a spiral flow path in which a second fluid introduced into the spiral flow path through a hole for introducing fluid into the mixer body formed in a peripheral wall of the mixer body is made to flow along an inner peripheral surface of the mixer body while being swirled in a spiral manner about an axis of the axial flow path so that the first fluid and the second fluid are mixed with each other and a mixture formed of the first fluid and the second fluid is made to exit from the opening portion at the other end.

Such a fluid mixer is, for example, arranged in the inside of a vessel which stores the second fluid which forms a continuous phase. The first fluid which forms a dispersion phase is made to flow through the axial flow path along the axial direction through the opening portion at one end to the opening portion at the other end of the mixer body (for example, the first fluid being sucked by a suction pump into the axial flow path from a side where the opening portion on the other end is formed). Due to such a constitution, pressure in the axial flow path can be reduced so that the second fluid can be introduced by suction into the mixer body through the hole for introducing fluid into the mixer body. Next, the second fluid introduced by suction into the mixer body through the hole for introducing fluid into the mixer body formed in the mixer body is made to form a swirl flow in a spiral manner through the spiral flow path around the first fluid which flows through the axial flow path so that the first fluid is sheared and dispersed over the whole region of the spiral flow path. As a result, the first fluid and the second fluid are uniformly mixed with each other.

In such an operation, the second fluid is made to form the swirl flow in a spiral manner about the axis of the axial flow path through the spiral flow path. That is, the second fluid is made to swirl while a swirling radius of the second fluid is gradually decreased toward the axis (center) from an outer peripheral side of the axial flow path. Accordingly, the swirl flow is accelerated on an axis side and applies a shearing action to the first fluid at a high speed and hence, the first fluid is dispersed finely and uniformly.

The fluid mixer according to the invention described in claim 2 is, in the fluid mixer according to the invention described in claim 1, characterized in that an outer periphery of the mixer body is covered with a cover member with a predetermined gap maintained therebetween, a swirl flow path is formed in the inside of the cover member such that the second fluid introduced into the inside of the cover member through a hole for introducing fluid into the cover member formed in a peripheral wall of the cover member is made to flow along an inner peripheral surface of the cover member while being swirled about the axis of the axial flow path, and the second fluid is introduced into the hole for introducing fluid into the mixer body formed in the mixer body, and the first fluid which axially flows through the axial flow path and the second fluid which forms a swirl flow in a spiral manner around the first fluid are mixed with each other over the whole region of the spiral flow path, and a mixture of the first fluid and the second fluid is made to exit from the opening portion at the other end.

Such a fluid mixer is, for example, arranged in the inside of a vessel which stores the second fluid which forms a continuous phase. The first fluid which forms a dispersion phase is made to flow through the axial flow path along the axial direction through the opening portion at one end to the opening portion at the other end of the mixer body (for example, the first fluid being sucked by a suction pump into the axial flow path from the opening portion at the other end). Due to such a constitution, pressure in the axial flow path can be reduced so that the second fluid can be introduced by suction into the cover member from the cover introducing hole. Next, the second fluid introduced into the cover member is made to swirl through the swirl flow path and is also introduced by suction into the inside the mixer body through the hole for introducing fluid into the mixer body formed in the mixer body. Subsequently, the second fluid introduced by suction into the mixer body through the hole for introducing fluid into the mixer body formed in the mixer body is made to form a swirl flow in a spiral manner through the spiral flow path around the first fluid which flows through the axial flow path so that the first fluid is sheared and dispersed over the whole region of the spiral flow path. As a result, the first fluid and the second fluid are uniformly mixed with each other.

In such an operation, the second fluid is made to swirl about the axis of the axial flow path provisionally in the swirl flow path and, subsequently, is made to form the swirl flow in a spiral manner about the axis of the axial flow path through the spiral flow path. That is, the second fluid is made to swirl while gradually decreasing a swirling radius toward the axis (center) from an outer peripheral side of the axial flow path. Accordingly, the swirl flow is accelerated on an axis side and applies a shearing action to the first fluid at a high speed and hence, the first fluid is dispersed finely and uniformly.

Further, the fluid mixer can be constituted of the cylindrical mixer body having the opening portions on both ends thereof, and the cover member which covers the outer periphery of the mixer body with a predetermined gap maintained therebetween and hence, the fluid mixer which is light-weighted and has the simple structure can be manufactured at a low cost using a synthetic resin or the like.

The fluid mixer according to the invention described in claim 3 is, in the fluid mixer according to the invention described in claim 1 or 2, characterized in that the mixer body includes: a proximal-end-side cylindrical portion which is formed with a diameter thereof gradually increasing toward the opening portion at the other end through the opening portion at one end; and a distal-end-side cylindrical portion which is formed with the approximately same diameter from a terminal end of the proximal-end-side cylindrical portion to the opening portion at the other end, a plurality of slit-like holes for introducing fluid into the mixer body which extend with a predetermined acute angle with respect to the longitudinal direction are formed in a peripheral wall of the distal-end-side cylindrical portion, and the respective holes for introducing fluid into the mixer body are arranged at intervals along a single imaginary spiral in the extending direction thereof.

In such a fluid mixer, the proximal-end-side cylindrical portion of the mixer body is formed such that the diameter of the proximal-end-side cylindrical portion is gradually increased, and the distal-end-side cylindrical portion of the mixer body is formed such that the diameter of the distal-end-side cylindrical portion is approximately equal from the terminal end of the proximal-end-side cylindrical portion to the opening portion at the other end thus making the second fluid form a swirl flow in a spiral manner in the distal-end-side cylindrical portion. Accordingly, the miscibility and the swirling property of the first fluid which is made to flow from the proximal-end-side cylindrical portion to the distal-end-side cylindrical portion and the second fluid which is made to form a swirl flow in a spiral manner in the distal-end-side cylindrical portion can be enhanced.

In forming the hole for introducing fluid into the mixer body, a plurality of slit-like holes for introducing fluid into the mixer body are formed in the peripheral wall of the distal-end-side cylindrical portion in such a manner that slit-like holes which extend while making a predetermined acute angle with respect to the longitudinal direction. The plurality of holes for introducing fluid into the mixer body are arranged along the single imaginary spiral. Accordingly, the second fluid which is introduced through the hole for introducing fluid into the mixer body is made to surely swirl in a spiral manner in the mixer body.

The fluid mixer according to the invention described in claim 4 is, in the fluid mixer according to the invention described in claim 2 or 3, characterized in that a slit-like hole for introducing fluid into the cover member which extends along the longitudinal direction of the cover member is formed in a peripheral wall of the cover member.

In such a fluid mixer, the hole for introducing fluid into the cover member is formed in the peripheral wall of the cover member in a slit shape which extends in the longitudinal direction of the cover member. Accordingly, the second fluid which is introduced through the hole for introducing fluid into the cover member is made to flow along an inner peripheral surface of the cover member and is made to surely swirl. Accordingly, the second fluid which forms a continuous phase is changed to a spiral swirl flow on the inner periphery from a provisional swirl flow on the outer periphery thus forming a high-speed swirl flow and thereby the second fluid imparts a shearing and dispersion action on the first fluid which forms a dispersion phase. As a result, the first fluid is refined and homogenized at a sub-micro level.

A fluid mixing method according to the invention described in claim 5 is characterized in that a first fluid which flows through the axial flow path along the axial direction of an axial flow path, and a second fluid which forms a swirl flow through a swirl flow path and, thereafter, forms a swirl flow in a spiral manner through a spiral flow path on the outer periphery of the first fluid are mixed with each other while being made to flow in the axial direction of the axial flow path.

In such a fluid mixing method, the first fluid is made to flow through the axial flow path along the axial direction of the axial flow path, and the second fluid which forms a swirl flow provisionally on an outer periphery of the first fluid and, thereafter, forms a high-speed swirl flow in a spiral manner through the spiral flow path can be mixed to the first fluid while being made to flow in the axial direction of the axial flow path. As a result, the first fluid which forms a dispersion phase is refined and, at the same time, is uniformly dispersed into the second fluid which forms a continuous phase.

A fluid mixing method according to the invention described in claim 6 is, in the fluid mixing method according to the invention described in claim 5, characterized in that, in the inside of a vessel which stores the second fluid therein, the first fluid is made to flow along the axial direction in the axial flow path thus reducing a pressure in the axial flow path and thereby the second fluid stored in the vessel is sucked into the axial flow path and is made to form a swirl flow in a spiral manner in the axial direction of the axial flow path.

In such a fluid mixing method, the pressure in the axial flow path is reduced by making the first fluid flow in the axial flow path along the axial direction so that the second fluid can be introduced into the axial flow path while being swirled and thereby a shearing and dispersion action is imparted on the first fluid. Accordingly, it is possible to favorably refine the first fluid which forms a dispersion phase, and it is also possible to favorably homogenize the second fluid which forms a continuous phase. Further, such a mixed fluid can be produced within a short time at a low cost.

Advantageous Effects of Invention

The present invention acquires the following advantageous effects. That is, the fluid mixing device according to the present invention has the simple structure, is light-weighted and compact, and can be manufactured at a low cost. Accordingly, the fluid mixing device according to the present invention can acquire an extremely advantageous effect with respect to a required initial cost. A cleaning operation and a maintenance operation of the fluid mixing device can be performed readily and easily. The fluid mixing method according to the present invention can efficiently shear and disperse the first fluid which forms a dispersion phase. Further, the first fluid can be refined and homogenized at a micro level or at a sub-micro level. Accordingly, a large amount of mixed fluid can be produced within a short time at a low cost. Particularly, according to the present invention, micro emulsion (emulsion at a micro order) can be produced by making two phases (liquid phase-liquid phase) swirl and mixed with each other at a high speed and hence, an emulsifying speed can be remarkably enhanced. Accordingly, the fluid mixing method according to the present invention is suitable for the mass production of emulsion within a short time at a low cost.

BRIEF DESCRIPTION OF THE DRAWINGS

FIG. 27 is a table showing the number of particles of an oleic acid.

FIG. 28 is a table indicating viscosities of various oils, and average particle sizes and the number of particles which are confirmed in the measurement of the particle size distribution.

MODE FOR CARRYING OUT THE INVENTION

Hereinafter, embodiments of the present invention are explained in conjunction with drawings.

Figure 1:
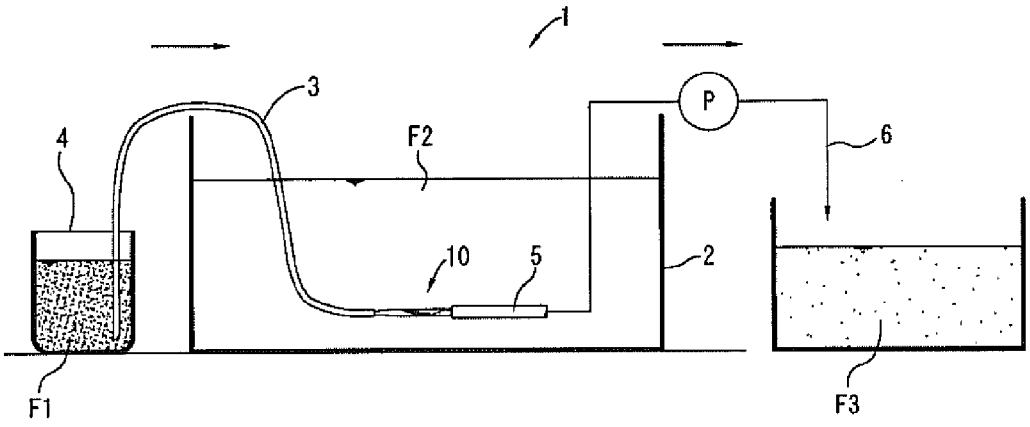
FIG. 1 is an explanatory view of a fluid mixing device according to the first embodiment.
Figure 2:
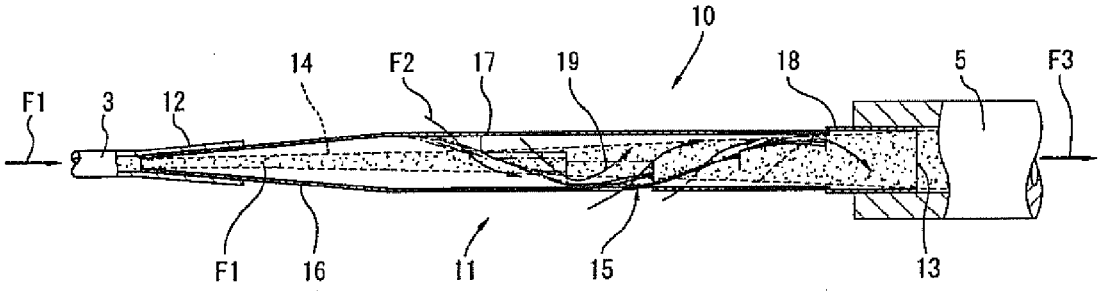
FIG. 2 is an explanatory cross-sectional front view of a fluid mixer according to the first embodiment.
Figure 3:
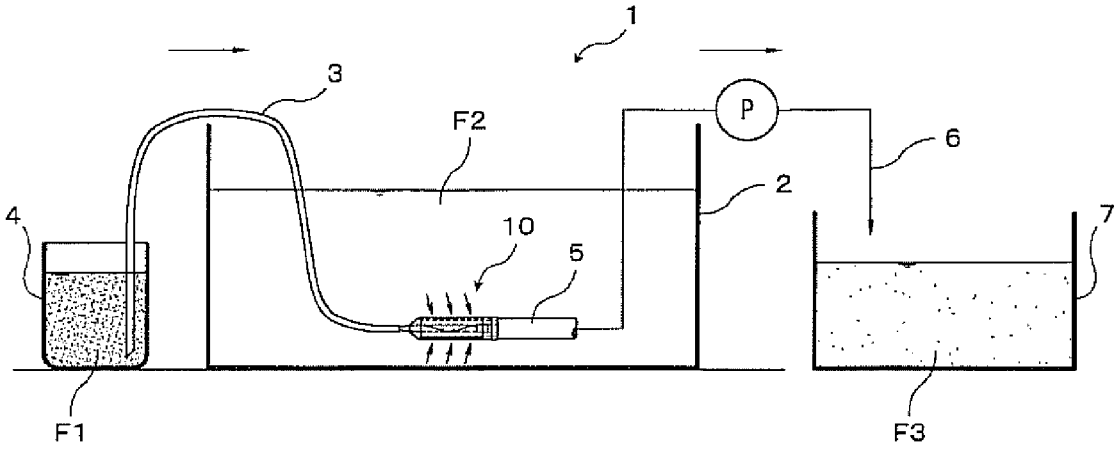
FIG. 3 is an explanatory view of a fluid mixing device according to the second embodiment.

Symbol 1 shown in FIG. 1 indicates a fluid mixing device according to the first embodiment, and the fluid mixing device 1 includes a fluid mixer 10 according to the first embodiment shown in FIG. 2. In FIG. 3, symbol 1 indicates a fluid mixer according to the second embodiment. The fluid mixing device 1 includes a fluid mixer 10 according to the second embodiment shown in FIG. 4. The fluid mixing device 1 according to the first embodiment and the fluid mixing device 1 according to the second embodiment are provided for mixing a first fluid F1 and a second fluid F2 as shown in FIG. 1 and FIG. 3 respectively. In the embodiments of the present invention, the explanation is made assuming that the first fluid F1 is a liquid which forms a dispersion phase (oil, for example), and the second fluid F2 is a liquid which forms a continuous phase (water, for example).

[Explanation of Fluid Mixing Device 1]

The fluid mixing device 1 according to the first embodiment (second embodiment) is, as shown in FIG. 1 (FIG. 3), configured such that the second fluid F2 is stored in the vessel-shaped second fluid storing portion 2 having an open-ended upper surface. The fluid mixer 10 according to the first embodiment (second embodiment) is arranged in the second fluid F2. A first fluid storing portion 4 which stores the first fluid F1 therein is communicably connected to one end side (proximal end side) of the fluid mixer 10 by way of a first communication pipe 3 which constitutes a first communication path. A suction port (not shown in the drawing) of a suction pump P is communicably connected to the other end side (distal end side) of the fluid mixer 10 by way of a second communication pipe 5 which constitutes a second communication path. A mixed fluid storing portion 7 which stores a mixed fluid F3 therein is communicably connected to a discharge port (not shown in the drawing) of the suction pump P by way of a third communication pipe 6 which constitutes a third communication path.

Due to such a constitution, when the suction pump P performs a suction operation, the first fluid F1 stored in the first fluid storing portion 4 is introduced into the fluid mixer 10 through the first communication pipe 3, the second fluid F2 stored in the second fluid storing portion 2 is introduced into the fluid mixer 10 where pressure is reduced by a suction effect, and the first fluid F1 and the second fluid F2 are mixed with each other in the fluid mixer 10 so that the third fluid F3 is formed. The third fluid F3 passes through the second communication pipe 5, the suction pump P and the third communication pipe 6 sequentially and, then, is stored in the mixed fluid storing portion 7. The mixed fluid F3 can be suitably recovered from the mixed fluid storing portion 7.

[Explanation of Fluid Mixer 10]

Figure 4:
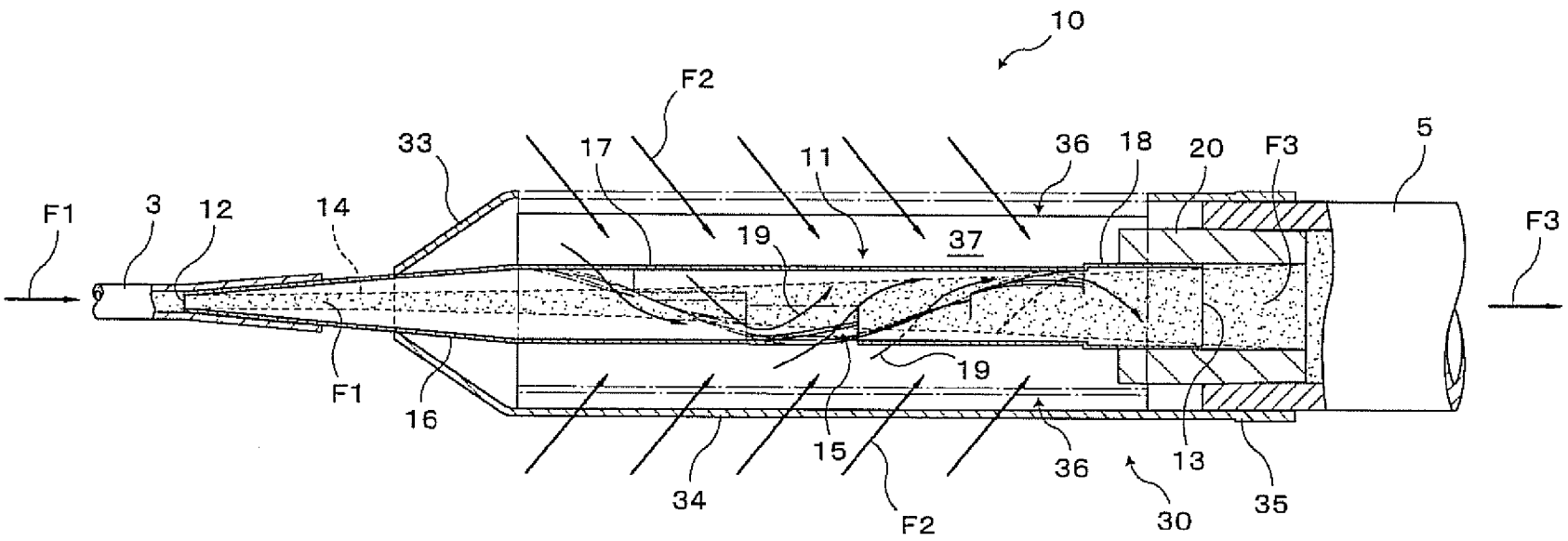
FIG. 4 is an explanatory cross-sectional front view of a fluid mixer according to the second embodiment.

The fluid mixer 10 according to the first embodiment is, as shown in FIG. 1 and FIG. 2, constituted of only a cylindrical mixer body 11 which has an opening portion on both ends thereof. The fluid mixer 10 according to the second embodiment is, as shown in FIG. 3 and FIG. 4, configured such that an outer periphery of the mixer body 11 is covered with a cylindrical cover member 30 with a predetermined gap therebetween, and the mixer body 11 and the cover member 30 are arranged concentrically (duplicate cylindrical shape). The fluid mixer 10 according to the second embodiment is constituted such that the mixer body 11 is inserted into the inside of the cover member 30 in a detachable manner, and a proximal end portion of the mixer body 11 projects from the cover member 30. The fluid mixer 10 is made of synthetic resin and has a small wall thickness so that the fluid mixer 10 is light-weighted. The fluid mixer 10 has the simple structure so that the fluid mixer 10 is manufactured at a low cost. Further, the mixer body 11 can be removed from the cover member 30 and hence, the fluid mixer 10 can be easily disassembled into several parts whereby the cleaning operation and the maintenance operation of the respective parts can be performed.

In the fluid mixer 10 according to the first embodiment shown in FIG. 1 and FIG. 2, the first communication pipe 3 made of a flexible raw material is communicably connected to the mixer body 11 in a state where a distal end portion of the first communication pipe 3 is detachably fitted on a proximal end portion of the mixer body 11. The second communication pipe 5 made of a flexible raw material is communicably connected to the mixer body 11 in a state where a proximal end portion of the second communication pipe 5 is detachably fitted on an outer peripheral surface of a distal end portion of the mixer body 11.

The fluid mixer 10 according to the second embodiment is, as shown in FIG. 3 and FIG. 4, configured such that the mixer body 11 and the first communication pipe 3 which is formed of a flexible raw material are communicably connected to each other in a state where a distal end portion of the first communication pipe 3 is detachably fitted on a proximal end portion of the mixer body 11. The mixer body 11 and the second communication pipe 5 are communicably connected to each other in a state where a spacer 20 which is formed in a circular cylindrical shape using an elastic rubber material is fitted on an outer peripheral surface of a distal end portion of the mixer body 11, and a proximal end portion of the second communication pipe 5 is detachably fitted between an outer peripheral surface of the spacer 20 and an inner peripheral surface of a distal end portion of the cover member 30.

The fluid mixers 10 according to the first and second embodiments having such constitutions can be easily mounted on or dismounted from the first and second communication pipes 3, and hence, the cleaning operation and the maintenance operation of the fluid mixers 10 can be easily performed.

[Explanation of Mixer Body 11]

As shown in FIG. 8 to FIG. 11, the mixer body 11 is formed into a straight shape, and is constituted of: a proximal-end-side cylindrical portion 16; a circular-cylindrical-shaped distal-end-side cylindrical portion 17, and a distal-end-side cylindrical portion 18. The proximal-end-side cylindrical portion 16 is formed in a funnel shape with a diameter thereof gradually increased toward an opening portion 13 at the other end from an opening portion 12 at one end. The circular-cylindrical-shaped distal-end-side cylindrical portion 17 and the distal-end-side cylindrical portion 18 are formed with the approximately same diameter from a terminal end of the proximal-end-side cylindrical portion 16 to the opening portion 13 at the other end. Symbol L1 indicates a longitudinal length of the mixer body 11, and symbol L2 indicates a longitudinal length of the proximal-end-side cylindrical portion 16. Symbol θ1 indicates an inclination angle of a peripheral surface of the proximal-end-side cylindrical portion 16. Symbol D1 indicates an inner diameter of the opening portion 12 at one end, symbol D2 indicates an inner diameter of the opening portion 13 at the other end, and symbol D3 indicates an inner diameter of the distal-end-side cylindrical portion 17.

Figure 9:
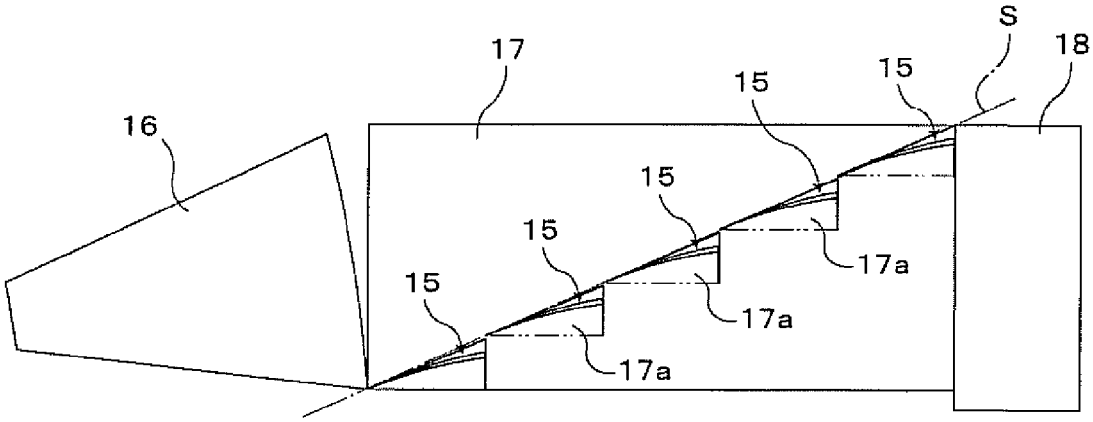
FIG. 9 is an explanatory developed view of the mixer body.
Figure 10:
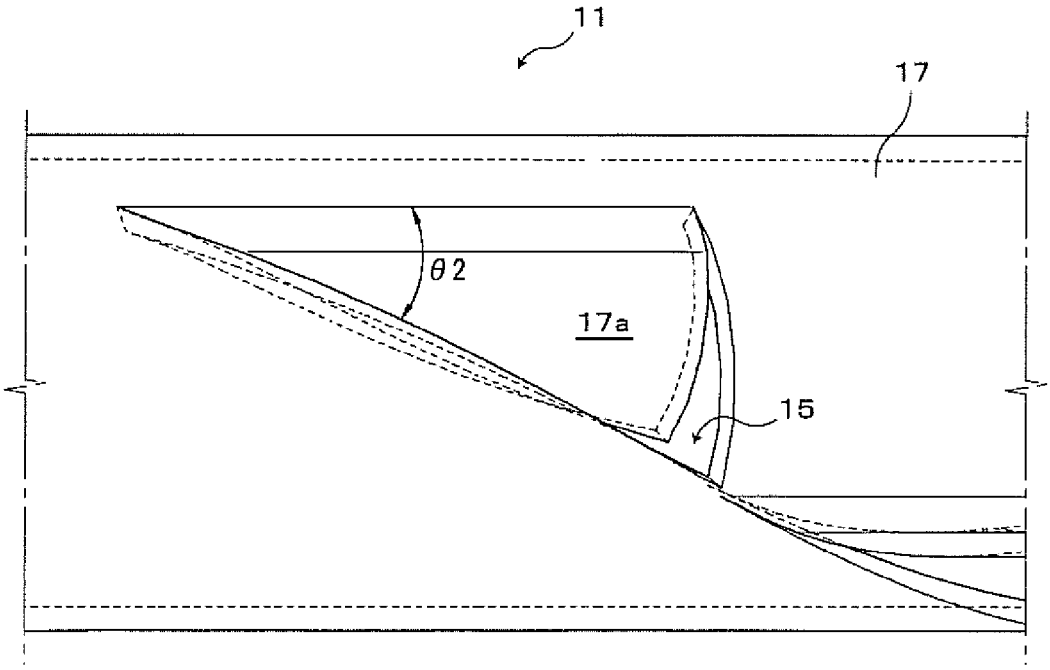
FIG. 10 is an explanatory view of a hole for introducing fluid into a body.
Figure 11:
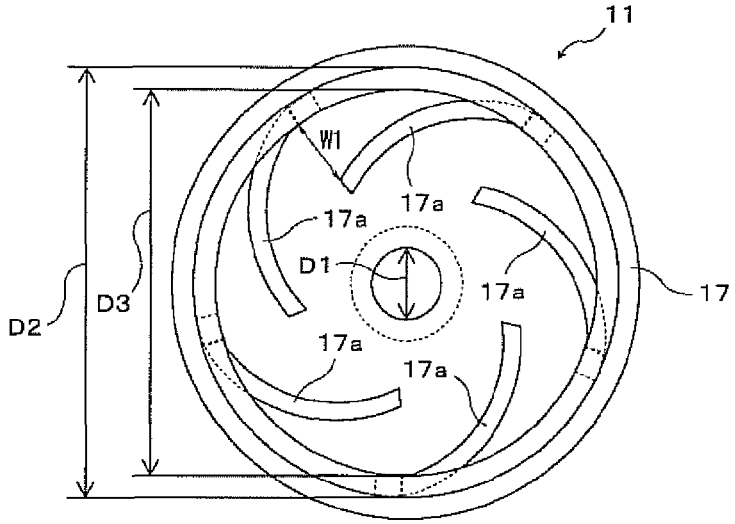
FIG. 11 is an explanatory right side view of the mixer body.
Figure 12:
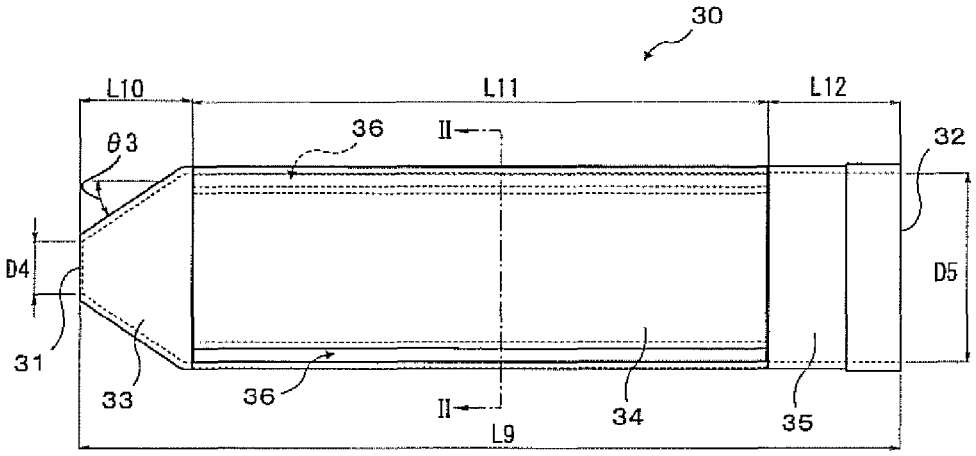
FIG. 12 is an explanatory front view of a cover member.
Figure 13:
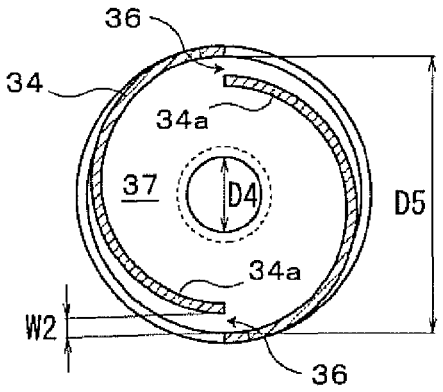
FIG. 13 is a cross-sectional view taken along a line II-II in FIG. 12.

A peripheral wall of the distal-end-side cylindrical portion 17 is equidistantly divided into five parts in the axial direction such that the lengths L3 to L7 of five divided parts are equal in the axial direction. Slit-like holes 15 (in this embodiment, five holes) for introducing fluid into the mixer body which extend while making a predetermined acute angle θ2 (for example, within a range from 20° to 30°) with respect to the longitudinal direction are formed in the peripheral wall of the distal-end-side cylindrical portion 17 within the lengths L3 to L7 in the axial direction respectively. The respective holes 15 for introducing fluid into the mixer body 11 are arranged along a single imaginary spiral S which is drawn on the peripheral wall of the distal-end-side cylindrical portion 17, and are arranged at predetermined intervals in the extending direction of the single imaginary spiral S. As shown in FIG. 9, the single imaginary spiral S is drawn as an imaginary straight line in a state where the distal-end-side cylindrical portion 17 is developed, and the slit-like holes 15 for introducing fluid into the mixer body 11 are formed on the imaginary straight line at predetermined intervals. Further, in the original distal-end-side cylindrical portion 17 which is formed by being bent into a cylindrical shape, the imaginary straight line draws the single imaginary spiral S. Symbol L8 indicates a length of the distal end cylindrical portion 18 in the axial direction.

Each hole 15 for introducing fluid into the mixer body 11 is formed such that a portion of a peripheral wall of the distal-end-side cylindrical portion 17 is cut on the single imaginary spiral S, and an edge portion 17*a* at one side end formed by cutting the opening portion 13 at the other end side in the circumferential direction is bent inward so that the hole 15 for introducing fluid into the mixer body 11 is opened while gradually increasing a diameter thereof toward the opening portion 13 at the other end side from the opening portion 12 at one end. Symbol W1 indicates a maximum opening width of the hole 15 for introducing fluid into the mixer body 11.

An outer surface of the edge portion 17*a* at one side end is bent in an outwardly projecting manner (in the radial direction of the distal-end-side cylindrical portion 17), and functions as an introducing guiding surface for the second fluid F2 which is introduced from the hole 15 for introducing fluid into the mixer body 11. On the other hand, an inner surface of the edge portion 17*a* at one side end functions as a swirl guiding surface for the second fluid F2 which flows in a swirling manner. Accordingly, the edge portion 17*a* at one side end which forms each hole 15 for introducing fluid into the mixer body 11 which is arranged along the single imaginary spiral S surely guides swirling of the second fluid F2 in a spiral manner.

As shown in FIG. 2, in the mixer body 11, a straight-shaped axial flow path 14 which makes the first fluid F1 introduced from the opening portion 12 at one end flow in the axial direction and exit from the opening portion 13 at the other end is formed. Further, a spiral flow path 19 is formed on a peripheral portion of the distal-end-side cylindrical portion 17 of the mixer body 11. In the spiral flow path 19, the second fluid F2 which is introduced through the holes 15 for introducing fluid into the mixer body 11 is made to flow around the outer periphery of the axial flow path 14 about an axis of the axial flow path 14 along the inner peripheral surface of the distal-end-side cylindrical portion 17 while being swirled in a spiral manner. Then, the second fluid F2 which flows through the spiral flow path 19 is mixed into the first fluid F1 which flows through the axial flow path 14 by a dispersion-by-shearing action, and after mixing, the second fluid F2 and the first fluid F1 are made to exit from the opening portion 13 at the other end as a mixed fluid F3.

(Explanation of Cover Member 30)

As shown in FIG. 6, FIG. 7, FIG. 12 and FIG. 13, the cover member 30 is formed in a straight shape, and is constituted of: a cover proximal-end cylindrical portion 33 which is formed in a funnel shape by gradually increasing a diameter thereof in the direction from the opening portion 31 at one end toward the opening portion 32 at the other end; a cylindrical cover body 34 which extends in the direction toward the opening portion 32 at the other end from a terminal end of the cover proximal-end cylindrical portion 33 while having the substantially same diameter; and a cylindrical cover distal-end cylindrical portion 35 which extends in the direction from the terminal end of the cover body 34 to the opening portion 32 at the other end. An intermediate portion of an outer peripheral surface of the proximal-end-side cylindrical portion 16 of the mixer body 11 is brought into contact with an inner peripheral portion of the opening portion 31 at one end. Symbol L9 indicates a longitudinal length of the cover member 30, symbol L10 indicates an axial length of the cover proximal-end cylindrical portion 33, symbol L11 indicates a longitudinal length of the cover body 34, and symbol L12 indicates an axial length of the cover distal-end cylindrical portion 35. Symbol D4 indicates an inner diameter of the opening portion 31 at one end, and symbol D5 indicates an inner diameter of the opening portion 32 at the other end. Symbol θ3 indicates a peripheral-surface inclination angle of the cover proximal-end cylindrical portion 33, and the relationship of θ3>θ1 is established between the peripheral-surface inclination angle θ3 and the peripheral surface inclination angle θ1.

A plurality of (two in this embodiment) slit-like holes 36 for introducing fluid into the cover member 30 which extend straightly along the longitudinal direction are formed in the peripheral wall of the cover body 34 over the whole length of the cover body 34. A pair of (two) holes 36 for introducing fluid into the cover member 30 is arranged at positions in point symmetry with respect to the axis of the cover member 30. Each hole 36 for introducing fluid into the cover member 30 is formed such that a peripheral wall of the cover body 34 is cut straightly in the axial direction over the longitudinal length L11 of the cover body 34, and an edge portion 34*a* at one side end which has both ends thereof cut in the circumferential direction is bent inward so that the hole 36 for introducing fluid into the cover member 30 is formed in a state where the hole 36 opens in the direction toward the opening portion 13 at the other end from the opening portion 12 at one end while having the substantially same width.

In the edge portion 34*a* at one side end, an outer surface of the edge portion 34*a* at one side end which is bent in an outwardly projecting manner (in the radial direction of the cover body 34) and functions as an introducing guiding surface for the second fluid F2 which is introduced from the outer introducing hole 36, and an inner surface of the edge portion 34*a* at one side end functions as a swirling guiding surface for the second fluid F2 which is made to form a swirl flow. Accordingly, the edge portions 34*a* at one side end which form the pair of holes 36 for introducing fluid into the cover member 30 arranged at positions in point symmetry surely guide the second fluid F2 in a swirling manner.

Figure 5:
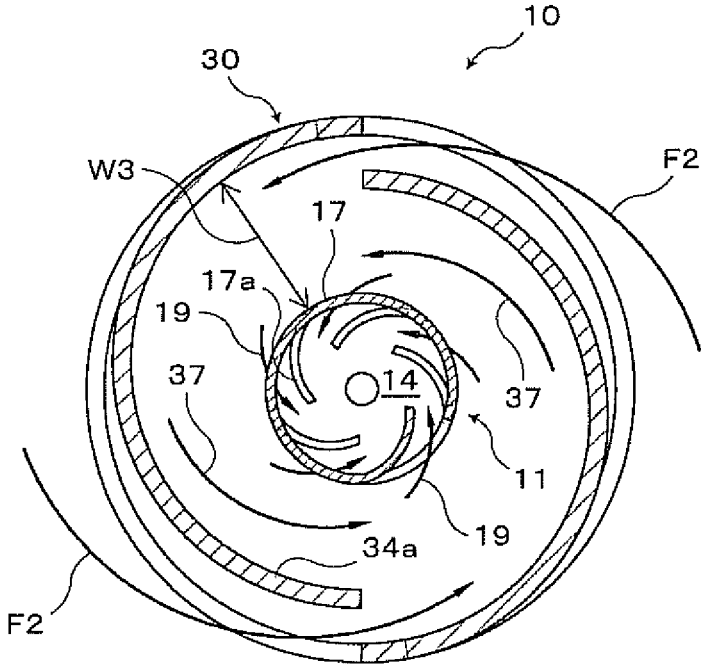
FIG. 5 is an explanatory cross-sectional right side view of the fluid mixer according to the second embodiment.
Figure 6:
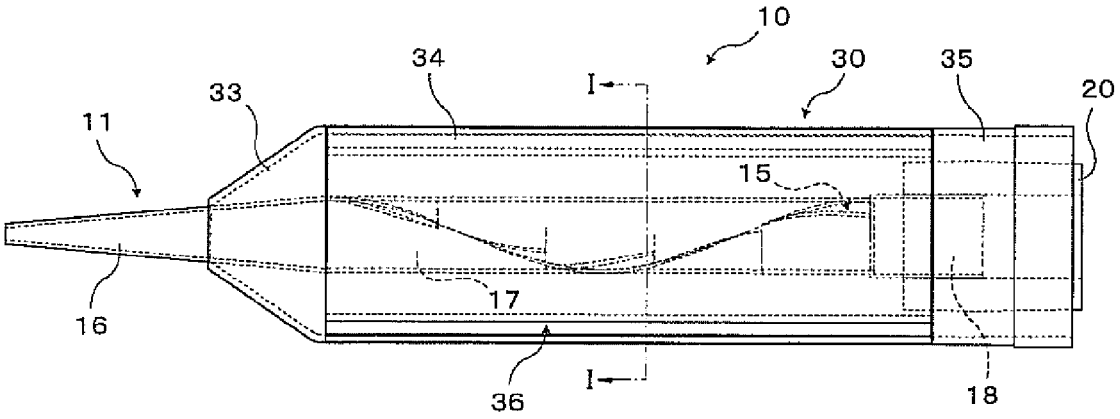
FIG. 6 is an explanatory front view of the fluid mixer according to the second embodiment.
Figure 7:
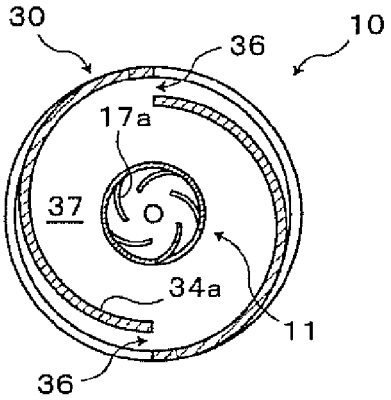
FIG. 7 is a cross-sectional view taken along a line I-I in FIG. 6.
Figure 8:
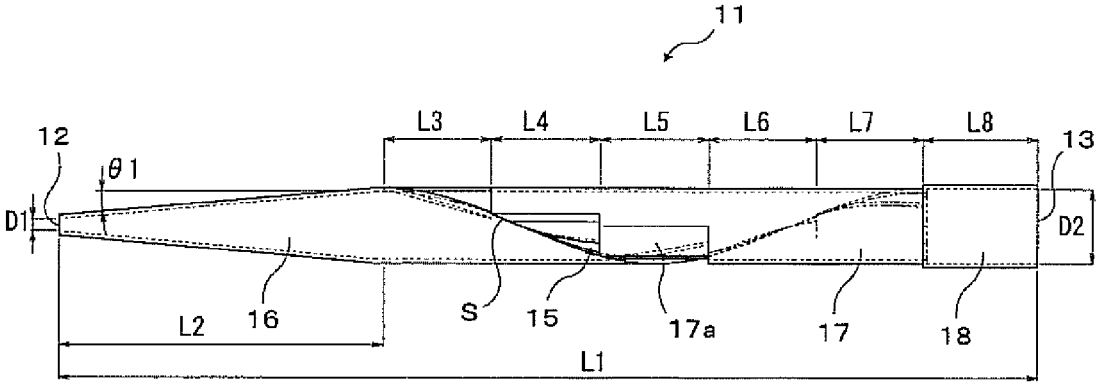
FIG. 8 is an explanatory front view of a mixer body.

Between an inner peripheral surface of the cover body 34 and an outer peripheral surface of the distal-end-side cylindrical portion 17 of the mixer body 11, as shown in FIG. 5, a cylindrical swirl flow path 37 is formed while maintaining a predetermined gap W3, and the second fluid F2 is made to form a swirl flow in the swirl flow path 37. The predetermined gap W3 which is a width of the swirl flow path 37 may be set to a value not more than an inner diameter of the mixer body 11 and not less than a half of the inner diameter of the mixer body 11. The gap W3 may preferably be set approximately equal to the inner diameter of the mixer body 11. In the swirl flow path 37, the second fluid F2 which is introduced from the holes 36 for introducing fluid into the cover member 30 is made to flow while being swirled about the axis of the axial flow path 14 along the inner peripheral surface of the cover body 34, and is introduced into the mixer body 11 through the holes 15 formed in the mixer body 11. Symbol W2 indicates a maximum opening width of the hole 36 for introducing fluid into the cover member 30.

Within the longitudinal length L11 of the holes 36 for introducing fluid into the cover member 30 which are formed in the peripheral wall of the cover body 34, five holes 15 for introducing fluid into the mixer body 11 which are formed in the peripheral wall of the distal-end-side cylindrical portion 17 of the mixer body 11 are arranged, and the second fluid F2 which is introduced into the cover body 34 through the holes 36 for introducing fluid into the cover member 30 is introduced into the mixer body 11 through five holes 15 for introducing fluid into the mixer body 11 while being swirled in the swirl flow path 37.

Due to such a constitution, as shown in FIG. 4 and FIG. 5, when the first fluid F1 is made to flow through the axial flow path 14 in the mixer body 11 along the axial direction, a pressure in the axial flow path 14 in the mixer body 11 is reduced. Then, due to such a pressure reduction effect, the second fluid F2 stored in the second fluid storing portion 2 is introduced into the cover body 34 while being swirled through the holes 36 for introducing fluid into the cover member 30 and is made to form a swirl flow in the swirl flow path 37 in the cover body 34. Then, the second fluid F2 which is made to form a swirl flow in the swirl flow path 37 is introduced into the mixer body 11 through the holes 15 for introducing fluid into the mixer body 11 and, at the same time, is made to form a swirl flow in a spiral manner around the first fluid F1 which axially flows through the axial flow path 14 so that the second fluid F2 is mixed with the first fluid F1 in a swirling manner over the whole region of the spiral flow path 19. In this manner, the first fluid F1 and the second fluid F2 are mixed with each other in a swirling manner thus producing the mixed fluid F3, and the mixed fluid F3 is made to exit from the opening portion 13 at the other end.

The second fluid F2 which forms a continuous phase is made to swirl about the axis of the axial flow path 14 provisionally in the swirl flow path 37 and, subsequently, is made to form the swirl flow in a spiral manner about the axis of the axial flow path 14 thorough the spiral flow path 19. That is, the second fluid F2 is made to swirl while gradually decreasing a swirling radius toward the axis (center) from an outer peripheral side of the axial flow path 14. Accordingly, the second fluid F2 which is made to swirl is accelerated on an axis side and applies a shearing action to the first fluid F1 which forms a dispersion phase at a high speed. As a result, the first fluid F1 is dispersed finely and is homogenized. Accordingly, the second fluid F2 can be mixed to the first fluid F1 in a swirling manner at a high speed whereby the first fluid F1 and the second fluid F2 can be uniformly mixed with each other.

Further, the proximal-end-side cylindrical portion 16 of the mixer body 11 is formed with a diameter thereof gradually increased and hence, the dispersibility of the first fluid F1 which is made to flow through the proximal-end-side cylindrical portion 16 can be gradually enhanced. The distal-end-side cylindrical portion 17 is formed with the approximately same diameter from the terminal end of the proximal-end-side cylindrical portion 16 to the distal-end cylindrical portion 18, and the second fluid F2 is made to form the swirl flow in a spiral manner in the distal-end-side cylindrical portion 17 and hence, the miscibility and the swirling property of the first fluid F1 which is made to flow from the proximal-end-side cylindrical portion 16 to the distal-end-side cylindrical portion 17 and the second fluid F2 which is made to form a swirl flowing in a spiral manner in the distal-end-side cylindrical portion 17 can be enhanced.

With respect to the holes 15 for introducing fluid into the mixer body 11, five slit-like holes 15 for introducing fluid into the mixer body 11 which extend with a predetermined acute angle θ2 with respect to the longitudinal direction are formed in the peripheral wall of the distal-end-side cylindrical portion 17, and five holes 15 for introducing fluid into the mixer body 11 are arranged along the single imaginary spiral S. Accordingly, the second fluid F2 which is introduced through the holes 15 for introducing fluid into the mixer body 11 is made to surely swirl in a spiral manner in the mixer body 11. Further, the holes 36 for introducing fluid into the cover member are formed in the peripheral wall of the cover body 34 in a slit shape which extends in the longitudinal direction of the cover body 34 and hence, the second fluid F2 which is introduced from the holes 36 for introducing fluid into the cover member 30 is made to flow along the inner peripheral surface of the cover body 34 and is made to surely swirl. Accordingly, the second fluid F2 which forms a continuous phase is changed to a spiral swirl flow on the inner periphery from a provisional swirl flow on the outer periphery thus forming a high-speed swirl flow and thereby the second fluid F2 imparts a shearing and dispersion action on the first fluid F1 which forms a dispersion phase. As a result, the first fluid F1 is refined and homogenized at a sub-micro level. As described above, the fluid mixer 10 according to the first embodiment is characterized by including at least the axial flow path 14 and the spiral flow path 19, and the fluid mixer 10 according to the second embodiment is characterized by including the swirl flow path 37 in addition to these flow paths 14, 19.

In this embodiment, the explanation has been made with respect to a mode where the fluid mixing device 1 provided with the fluid mixer 10 according to the first embodiment or the second embodiment is configure to use a liquid as the first fluid F1 and the second fluid F2 respectively and to mix these liquids with each other. However, the fluid mixing device 1 provided with the fluid mixer 10 may be configured to mix a liquid and a gas with each other or to mix a gas and a gas with each other. Further, sizes and the like of respective parts which constitute the fluid mixer 10 may be set in conformity with viscosities and the like of the first and second fluids F1, F2.

Next, the modifications of the fluid mixing device 1, the modifications of the second fluid storing portion 2, and the modifications of the fluid mixer 10 are explained. Parts having constitutions in common with the parts explained in conjunction with the first embodiment are explained by giving the same symbols.

[Explanation of First Modification of Fluid Mixing Device 1]

Figure 14:
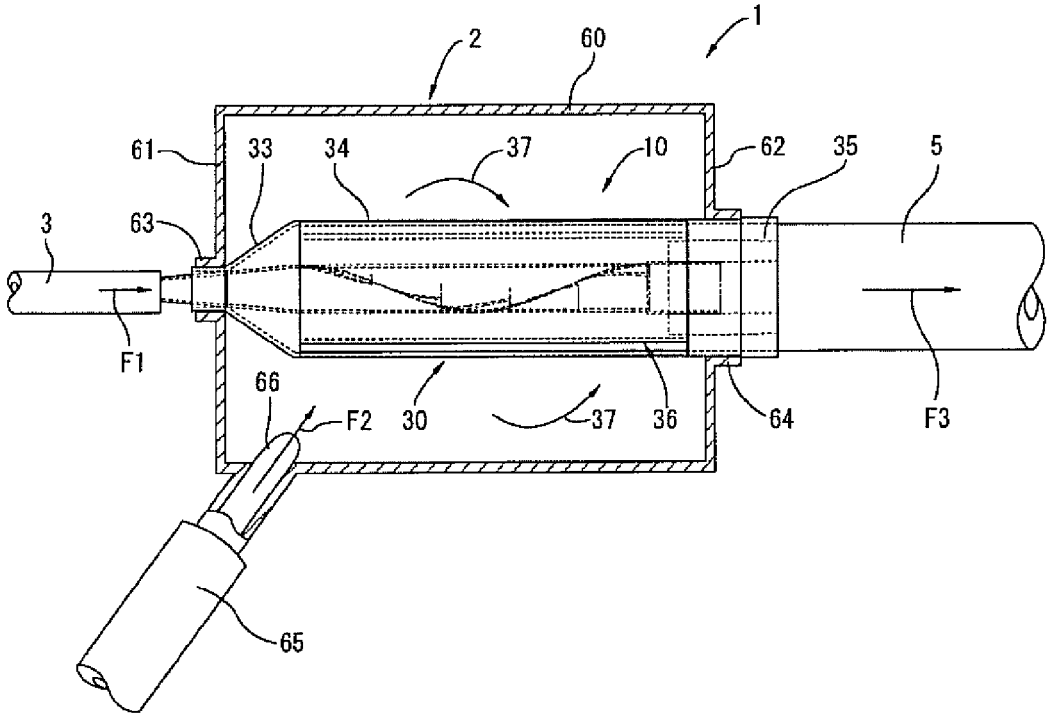
FIG. 14 is an explanatory cross-sectional front view of the first modification of the fluid mixing device according to the first embodiment.

The first modification of the fluid mixing device 1 is explained. That is, FIG. 14 is an explanatory cross-sectional front view of the first modification of the fluid mixing device 1 according to the first embodiment. The fluid mixing device 1 according to the first modification is, as shown in FIG. 14, configured such that the fluid mixer 10 according to the first embodiment is surrounded by a second fluid storing portion 2 which is formed of a closed case provided in the first modification. That is, a portion of the mixer body 11 which is positioned between an outer peripheral surface of an intermediate portion of the proximal-end-side cylindrical portion 16 and an outer peripheral surface of a proximal end portion of the second communication pipe 5 is surrounded by the second fluid storing portion 2 of the first modification. The second fluid storing portion 2 of the first modification is formed of a circular cylindrical peripheral wall forming body 40, a one-side end wall forming body 41 which is contiguously formed with one-side end portion of the peripheral wall forming body 40, and the other-side end wall forming body 42 which is contiguously formed with the other-side end portion of the peripheral wall forming body 40. The second fluid storing portion 2 can store the second fluid F2 therein. Symbol 43 indicates a proximal-end-side mounting portion which is mounted on the peripheral surface of the intermediate portion of the proximal-end-side cylindrical portion 16, and symbol 44 indicates a distal-end-side mounting portion which is mounted on the outer peripheral surface of a proximal end portion of the second communication pipe 5.

A distal end portion of a second fluid supply pipe 45 is communicably connected to a proximal end side of the peripheral wall forming body 40. An opening portion at distal end 46 of the second fluid supply pipe 45 is directed toward a downstream side at an inner peripheral surface of the peripheral wall forming body 40 so that the second fluid F2 which is sucked and flown into the second fluid supply pipe 45 from the opening portion at distal end 46 is made to form a swirl flow in a spiral manner about an axis of the mixer body 11. A proximal end portion of the second fluid supply pipe 45 is communicably connected to a second fluid accumulation source (not shown in the drawing).

Due to such a constitution, when the first fluid F1 is sucked and flown into the mixer body 11, a pressure in the mixer body 11 is reduced, the second fluid F2 in the second fluid accumulation source is sucked and flown into the second fluid storing portion 2 from the opening portion at distal end 46 through the second fluid supply pipe 45, and the sucked and flown second fluid F2 is made to form a swirl flow in a spiral manner about the axis of the mixer body 11. As a result, a provisional swirl flow path 37 is formed in the second fluid storing portion 2 according to the first modification, and the second fluid F2 is sucked into the mixer body 11 through the hole 15 for introducing fluid into the mixer body 11 while being swirled.

[Explanation of Second Modification of Fluid Mixing Device 1]

Figure 15:
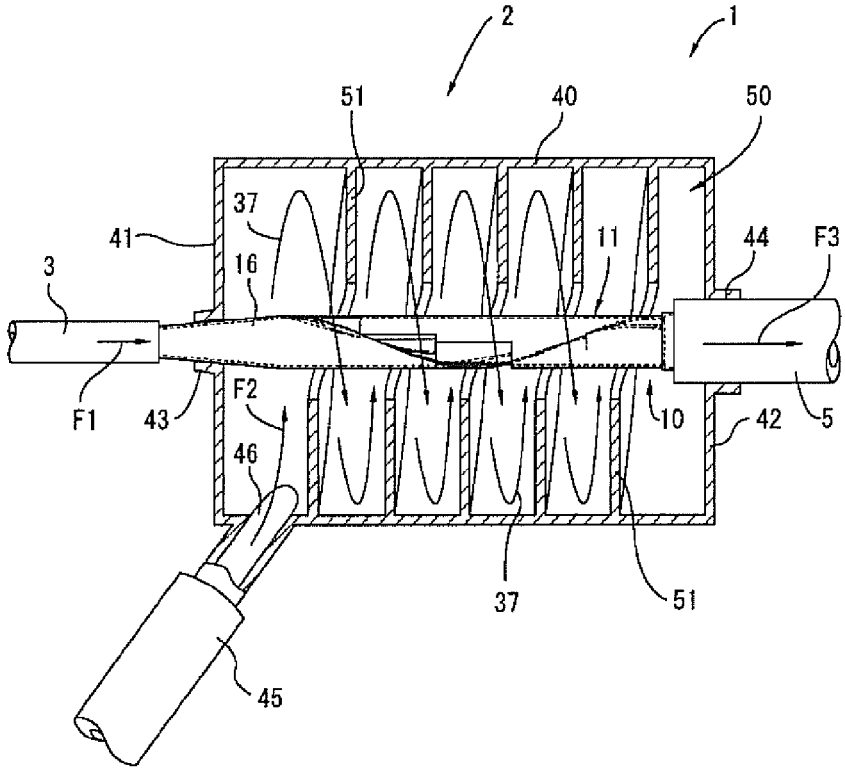
FIG. 15 is an explanatory cross-sectional front view of the second modification of the fluid mixing device according to the first embodiment.

The second modification of the fluid mixing device 1 is explained. That is, FIG. 15 is an explanatory cross-sectional front view of the second modification of the fluid mixing device 1 according to the first embodiment. The fluid mixing device 1 according to the second modification has, as shown in FIG. 15, the same basic constitution as the fluid mixing device 1 according to the above-mentioned first modification. However, the fluid mixing device 1 according to the second modification differs from the fluid mixing device 1 according to the first modification with respect to the following points. That is, in the second modification, the second fluid storing portion 2 is constituted such that a spiral swirl means 50 is arranged on an inner peripheral surface of the peripheral wall forming body 40. Due to such a constitution, in the second modification, a provisional swirl flow path 37 is formed in the second fluid storing portion 2 so that the second fluid F2 which is sucked and flown into the second fluid storing portion 2 is made to surely form a swirl flow in a spiral manner about the axis of the mixer body 11.

That is, in the second modification, the second fluid storing portion 2 is configured such that, as the swirl means 50, a strip-shaped swirl guiding member 51 is mounted on and along an inner peripheral surface of the circular cylindrical peripheral wall forming body 40 in a spiral manner about the axis of the peripheral wall forming body 40 and in a projecting manner toward the inside of the peripheral wall forming body 40. In the second modification, the second fluid F2 sucked and flown into the second fluid storing portion 2 is made to flow along side walls of the swirl guiding member 51 in a spiral manner about the axis of the peripheral wall forming body 40 and in a projecting manner toward the inside of the peripheral wall forming body 40 on the outer periphery of the mixer body 11, and is surely sucked into the mixer body 11 through the holes 15 for introducing fluid into the mixer body 11 while being swirled. The second fluid storing portion 2 according to the second modification may be configured such that a recessed groove is formed on the inner peripheral surface of the circular cylindrical peripheral wall forming body 40 in a spiral manner about the axis of the peripheral wall forming body 40, and the second fluid F2 is made to form a swirl flow in a spiral manner along the recessed groove thus being sucked into the mixer body 11 through the holes 15 for introducing fluid into the mixer body 11 while being swirled.

As described above, in the second modification of the fluid mixing device 1, by constituting the second fluid storing portion 2 in such a manner that the swirl means 50 is arranged in the second fluid storing portion 2 of the first modification, the second fluid storing portion 2 of the second modification can hold a swirl flow path forming function capable of surely forming the provisional swirl flow path 37. That is, the second fluid storing portion 2 of the second modification also functions as the cover member 30 for maintaining the swirl flow path forming function.

[Explanation of Third Modification of Fluid Mixing Device 1]

Figure 16:
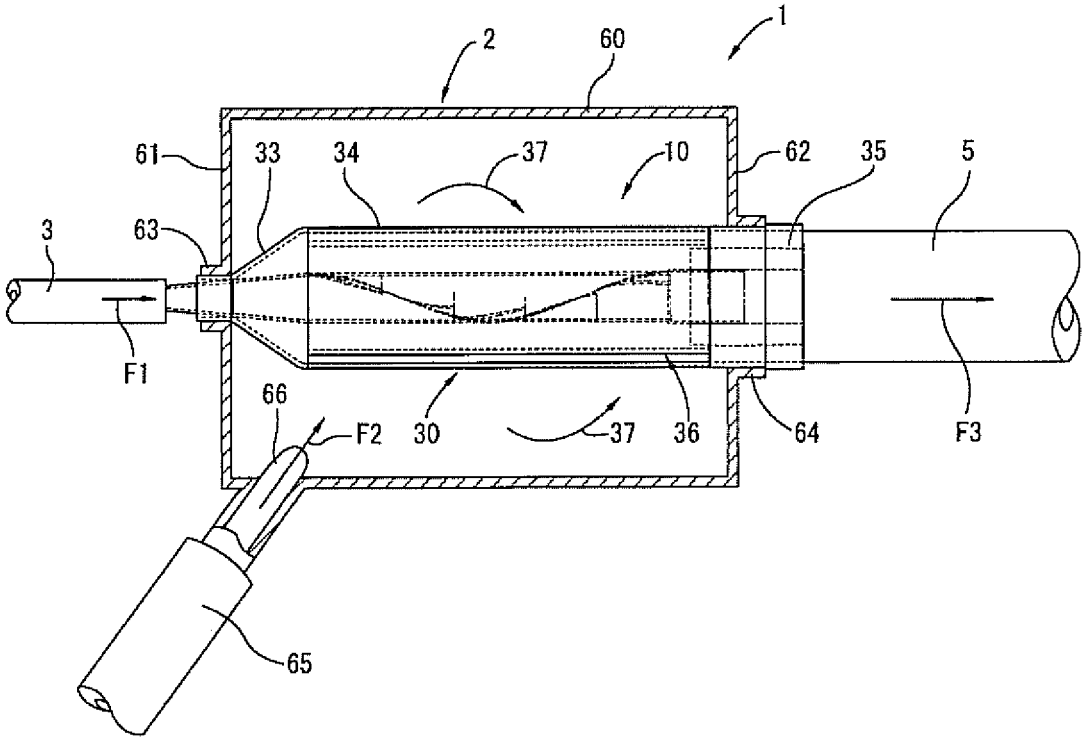
FIG. 16 is an explanatory cross-sectional front view of the third modification of the fluid mixing device according to the first embodiment.

The third modification of the fluid mixing device 1 is explained. That is, FIG. 16 is an explanatory cross-sectional front view of the third modification of the fluid mixing device 1 according to the first embodiment. As shown in FIG. 16, in the fluid mixing device 1 according to the third modification, the fluid mixer 10 of the second embodiment is surrounded by a second fluid storing portion 2 of the third modification which is formed of a closed case. That is, in the third modification, the second fluid storing portion 2 is configured to surround a portion of the cover member 30 which is positioned between an outer peripheral surface of a proximal end portion of the cover proximal-end cylindrical portion 33 and an outer peripheral surface of a proximal end portion of the second communication pipe 5. In the third modification, the second fluid storing portion 2 is constituted of: a circular cylindrical peripheral wall forming body 60; a one-side end wall forming body 61 which is contiguously formed on a one-side end portion of the peripheral wall forming body 60; and the other-side end wall forming body 62 which is contiguously formed on the other-side end portion of the peripheral wall forming body 60. The second fluid storing portion 2 can store the second fluid F2 therein. Symbol 63 indicates a proximal-end-side mounting portion which is mounted on a peripheral surface of an intermediate portion of the cover proximal-end cylindrical portion 33, and symbol 64 indicates a distal-end-side mounting portion which is mounted on an outer peripheral surface of a proximal end portion of the cover distal-end cylindrical portion 35.

A distal end portion of a second fluid supply pipe 65 is communicably connected to a proximal end side of the peripheral wall forming body 60. An opening portion 66 which is formed on a distal end of the second fluid supply pipe 65 is directed toward a downstream side at an inner peripheral surface of the peripheral wall forming body 60 so that the second fluid F2 which is sucked and flown into the second fluid supply pipe 65 from the opening portion 66 at a distal end is made to form a swirl flow in a spiral manner about an axis of the cover member 30. A proximal end portion of the second fluid supply pipe 65 is communicably connected to a second fluid storing source (not shown in the drawing).

Due to such a constitution, when the first fluid F1 is sucked and flown into the mixer body 11, a pressure in the mixer body 11 is reduced, the second fluid F2 in the second fluid storing source is sucked and flown into the second fluid storing portion 2 from the opening portion 66 at a distal end through the second fluid supply pipe 65, and the sucked and flown second fluid F2 is made to form a swirl flow in a spiral manner about the axis of the cover member 30. As a result, a provisional swirl flow path 37 is formed in the second fluid storing portion 2 of the first modification, and the second fluid F2 is sucked into the cover member 30 through the hole 36 for introducing fluid into the cover member 30 while being swirled.

[Explanation of Modification of Fluid Mixer 10 in the Form of Second Embodiment]

Figure 17:
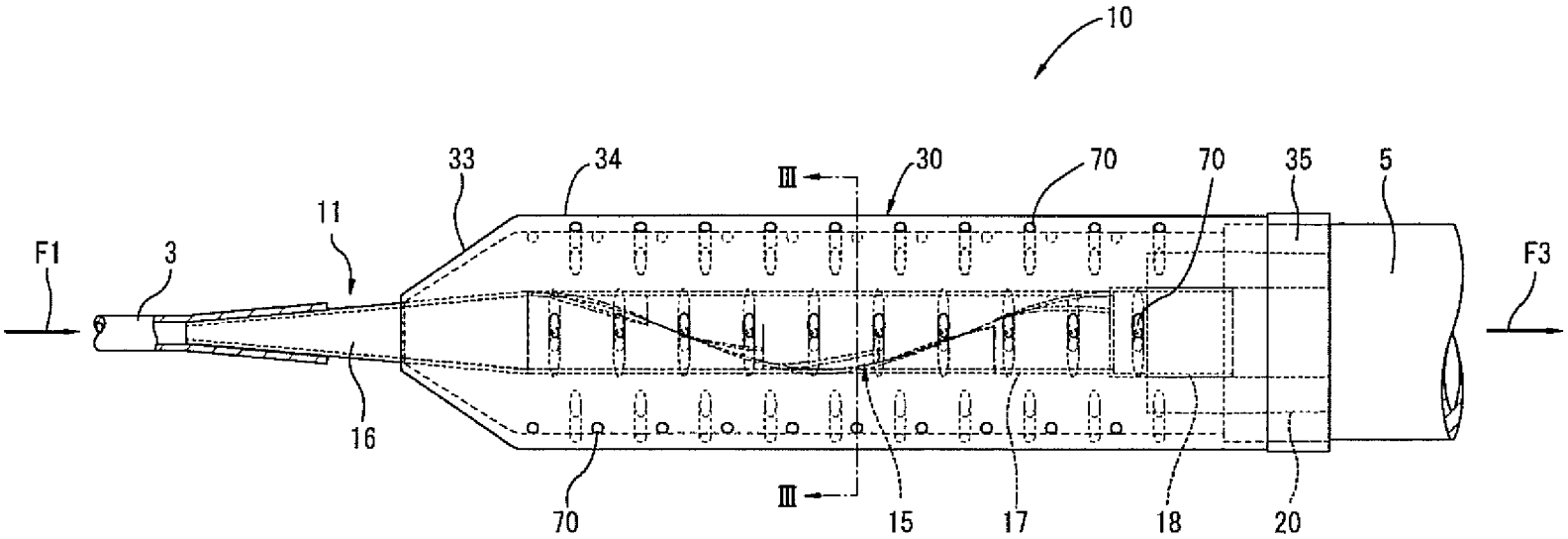
FIG. 17 is an explanatory cross-sectional front view of a modification of the fluid mixer according to the second embodiment.
Figure 18:
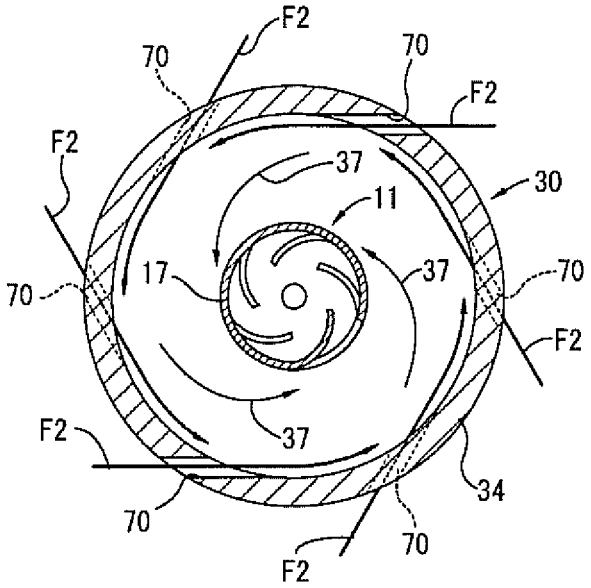
FIG. 18 is a cross-sectional view taken along a line in FIG. 17.

The modification of the fluid mixer 10 in the form of the second embodiment is explained. That is, FIG. 17 is an explanatory cross-sectional front view of the modification of the fluid mixer 10 according to the second embodiment, and FIG. 18 is a cross-sectional view taken along a line III-III in FIG. 17. The modification of the fluid mixer 10 according to the second embodiment is, as shown in FIG. 17 and FIG. 18, configured such that a large number of holes 70 for introducing fluid into the cover member 30 which extend linearly in the tangential line direction of the inner peripheral surface of the cover body 34 and penetrate the cover body 34 are formed in the cover body 34. That is, the holes 70 for introducing fluid into the cover member are formed in the cover body 34 at predetermined intervals in the axial direction of the cover body 34 and, at the same time, at predetermined intervals in the circumferential direction (in this embodiment, six holes 70 for introducing fluid into the cover member 30 being formed at intervals of 60° in the circumferential direction). The holes 70 for introducing fluid into the cover member 30 which are arranged adjacent to each other in the circumferential direction are arranged on an approximately imaginary spiral which extends in the axial direction on the outer peripheral surface of the cover body 34.

Due to such a constitution, as shown in FIG. 18, the second fluid F2 is sucked into the cover body 34 in the counterclockwise direction through the large number of respective holes 70 for introducing fluid into the cover member 30. Further, in the swirl flow path 37 in the cover body 34, the second fluid F2 is made to forma swirl flow along the inner peripheral surface of the mixer body 11 in a spiral manner about the axis of the mixer body 11. The second fluid F2 which is made to form the swirl flow is sucked into the mixer body 11 through the holes 15 for introducing fluid into the mixer body 11 while being swirled in the counterclockwise direction.

Recently, the technique for producing micro emulsion has been shifting to a technique where fine grooves are formed on a substrate using a photo resist available in a semiconductor field and oil (or water) is extruded through the grooves thus producing micro emulsion. This technique has an advantage that emulsion which contains particles having a uniform particle size can be produced. However, the technique has drawbacks such as a drawback that a unit cost of fine working is expensive and a drawback that time efficiency in the production of emulsion is low. To the contrary, the fluid mixing device 1 according to this embodiment has advantages such as the production of micro emulsion at a low cost and high time efficiency in the production of micro emulsion. That is, only with a variable control of an output of a suction pump which sucks water and oil into the fluid mixing device 1, the homogeneous micro emulsion can be produced in a wide range of amount from a small amount to a large amount and hence, the production of micro emulsion can be easily scaled up. Further, it is possible to produce micro emulsion which does not contain an emulsifying agent such as surfactant. That is, it is possible to produce micro emulsion having stability.

EXAMPLES

Example 1

In the example 1, an experiment for producing emulsion is performed using the fluid mixing device 1 according to the first embodiment shown in FIG. 1. That is, the experiment for producing emulsion is performed using the fluid mixer 10 according to the first embodiment.

In the example 1, the diameter D2 is set to 12 mm (D2=12 mm), the diameter D3 is set to 11 mm (D3=11 mm), the respective widths in the axial direction L3 to L7 are set to 15 mm (L3 to L7=15 mm), the inclination angle of peripheral surface θ1 is set to 7.5° (θ1=7.5°), the acute angle θ2 is set to 24° (θ2=24°), and the maximum opening width W1 is set to 1 mm (W1=1 mm).

Oil (edible oil) is used as the first fluid F1 (dispersion phase), and city water is used as the second fluid F2 (continuous phase). The displacement of the suction pump P is set to 23 l/min, and an introduced amount of oil is set to 100 ml/min. Emulsion is produced by 100 millimeter per minute under such conditions.

A size (particle size) of an oil droplet contained in emulsion produced in such an experiment is measured using a laser diffraction particle size distribution measuring device (SALD-2200 made by Shimadzu Corporation). The result of the measurement is shown in FIG. 19.

Figure 19:
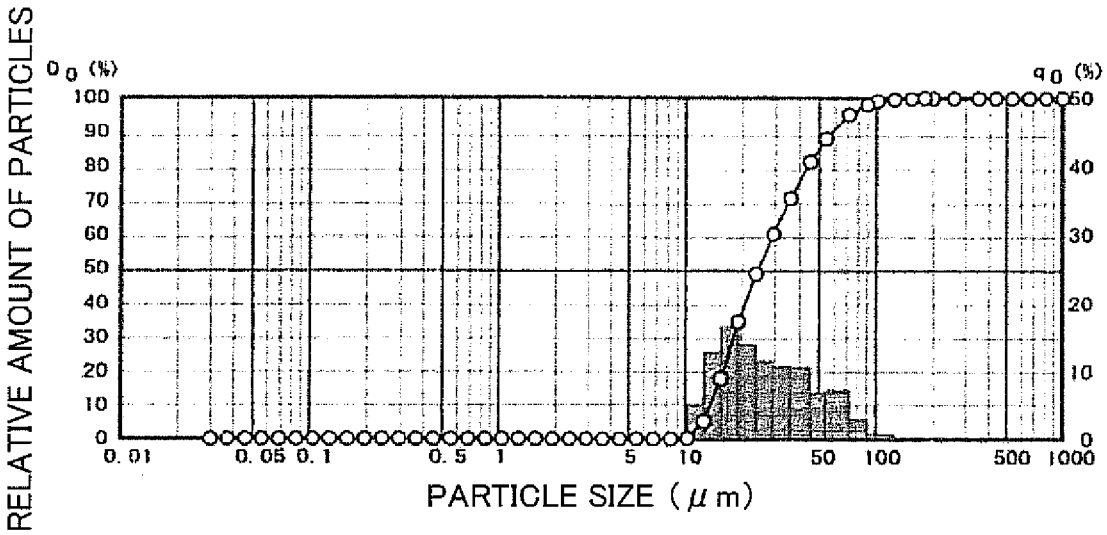
FIG. 19 is a graph showing a result of measurement of a size of oil droplets (particles) which form a dispersion phase in an emulsion produced by the mixer body.

As shown in FIG. 19 which is a graph, in case of the example 1, most of oil droplets contained in emulsion is refined into fine particles having a particle size within a range from 10 μm to 100 μm.

From this result of measurement, it is found that the mixer body 11 of this embodiment has the excellent performance that fine oil droplets at a micro level can be produced.

Example 2

In the example 2, an experiment for producing emulsion is performed using the fluid mixing device 1 according to the second embodiment shown in FIG. 3. That is, the fluid mixer 10 according to the second embodiment is assembled by mounting the cover member 30 on the mixer body 11 used in the experiment in the example 1, and the experiment for producing emulsion is performed using this fluid mixer 10.

Here, with respect to the cover member 30 used in this example 2, the longitudinal length L9 is set to 113 mm (L9=113 mm), the axial width L10 is set to 14 mm (L10=14 mm), the longitudinal length L11 is set to 83 mm (L11=83 mm), the axial width L12 is set to 16 mm (L12=16 mm), the inner diameter D4 is set to 7 mm (θ4=7 mm), the inner diameter D5 is set to 28 mm (D5=28 mm), the inclination angle θ3 of peripheral surface is set to 34° (θ3=34°), the maximum opening width W2 is set to 1 mm (W2=1 mm), and the predetermined gap W3 is set to 8 mm (W3=8 mm).

In the same manner as the example 1, oil (edible oil) is used as the first fluid F1 (dispersion phase), and city water is used as the second fluid F2 (continuous phase). The displacement of the suction pump P is set to 23 l/min, and an introduced amount of oil is set to 100 ml/min. Emulsion is produced under such conditions at a production rate of 100 ml/min.

A size (particle size) of oil droplets contained in emulsion produced in this experiment is measured using a laser diffraction particle size distribution measuring device (SALD-2200 made by Shimadzu Corporation). The result of the measurement is shown in FIG. 20.

Figure 20:
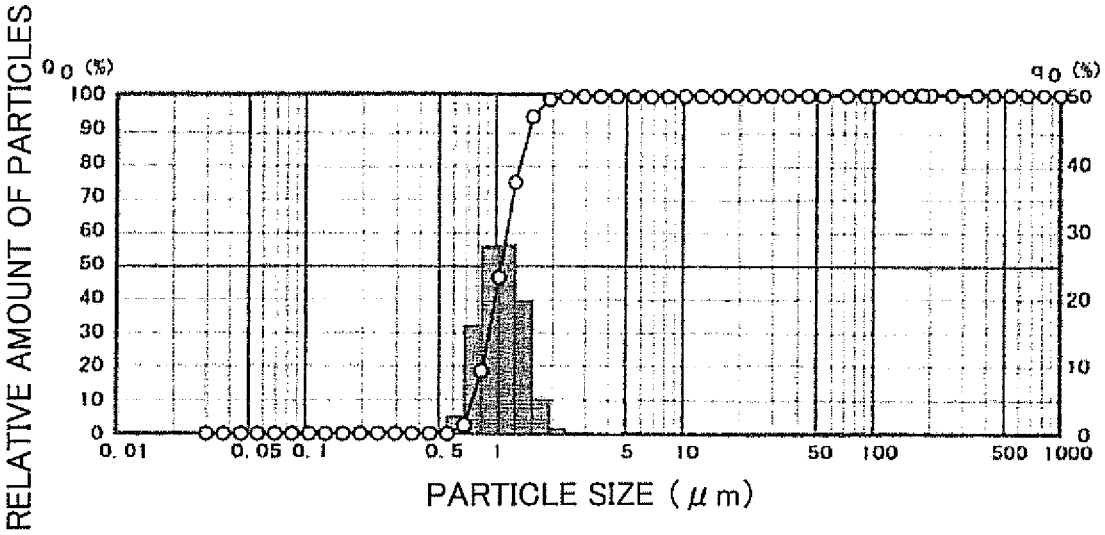
FIG. 20 is a graph showing a result of measurement of a size of oil droplets (particles) which forma dispersion phase in an emulsion produced by the fluid mixer according to the present invention.

As shown in a graph in FIG. 20, it is confirmed that most of oil droplets contained in emulsion mainly have a particle size of approximately 1 μm in case of the example 2.

From this result of measurement, it is found that the fluid mixer 10 of the second embodiment has the excellent performance that the fluid mixer 10 can produce extremely fine oil droplets at a sub micro level, and also has the excellent performance that the fluid mixer 10 can produce oil droplets having the uniform particle size. Further, from this result of measurement, it is also found that the fluid mixer 10 of the second embodiment has the extremely excellent emulsion production ability (fluid mixing ability).

Example 3

Next, an experiment substantially equal to the experiment in the example 2 is carried out using an oleic acid which is a main component of edible oil as an object to be emulsified. In this experiment, an experiment where an acute angle θ2 is changed to 15° and an experiment where the acute angle θ2 is changed to 30° are also carried out. Further, the viscosity of oil to be emulsified is focused as a physicochemical element, by focusing on, and the investigation is made using soybean oil, rapeseed oil, corn oil, olive oil and camellia oil which differ from each other in viscosity. As a dispersion solution, water (city water) is used.

To evaluate produced emulsions, particles are observed using a microscope (made by KEYENCE Corporation), a particle size is observed by a particle size distribution device (made by Shimadzu Corporation), and the number of particles is observed by a particle counter (made by Beckman Coulter, Inc.) respectively.

(Result and Consideration)

Oleic Acid

Figure 21:
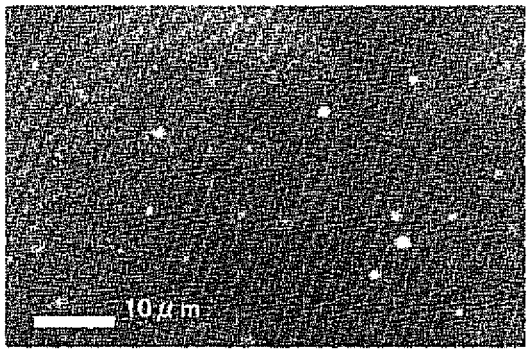
FIG. 21 is a view showing a microscope image of a micro emulsion into which an oleic acid is introduced.
Figure 22:
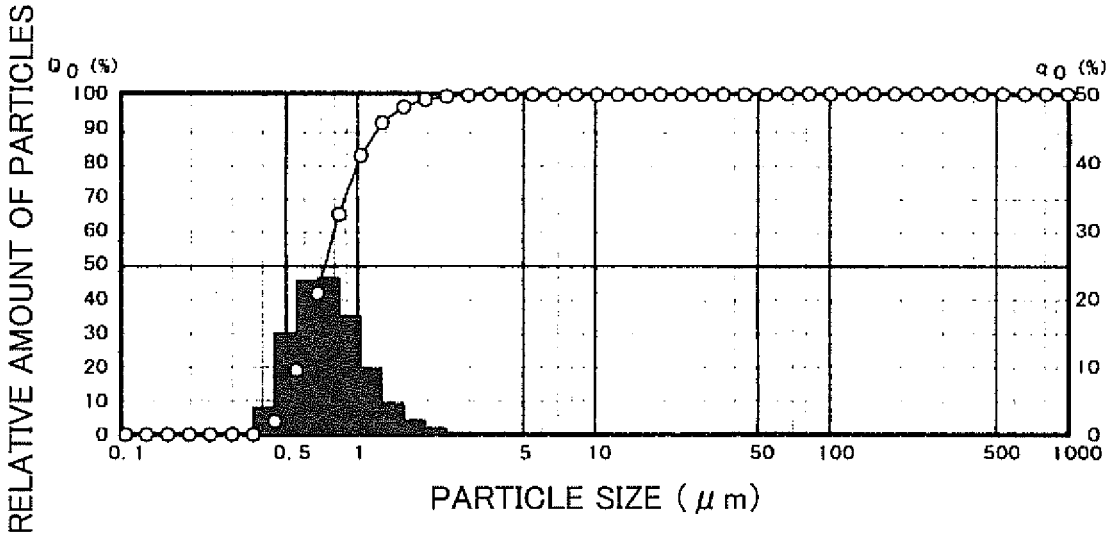
FIG. 22 is a graph showing the particle size distribution of a micro emulsion into which an oleic acid is introduced by an amount of 50 ml/min using a fluid mixer having an acute angle θ2 of 24°.

1) FIG. 21 shows a microscope image and FIG. 22 shows particle size distribution of micro emulsion when an oleic acid is introduced at a flow rate of 50 ml/min using the fluid mixer 10 where the acute angle θ2 is set to 24° (production amount: 16 l/min). It is confirmed from FIG. 21 that produced emulsion particles have a spherical shape (relatively large particles having a particle size of approximately 2 μm). It is also confirmed from FIG. 22 that relatively homogenized emulsion having a peak in particle size at approximately 0.7 μm (mode size) is produced. The number of particles in the produced emulsion is counted using a particle counter, and it is confirmed that the number of particles in the produced emulsion is approximately $33\times10^6$/ml (total amount of particles in emulsion having a particle size of 3 μm or less).

Figure 23:
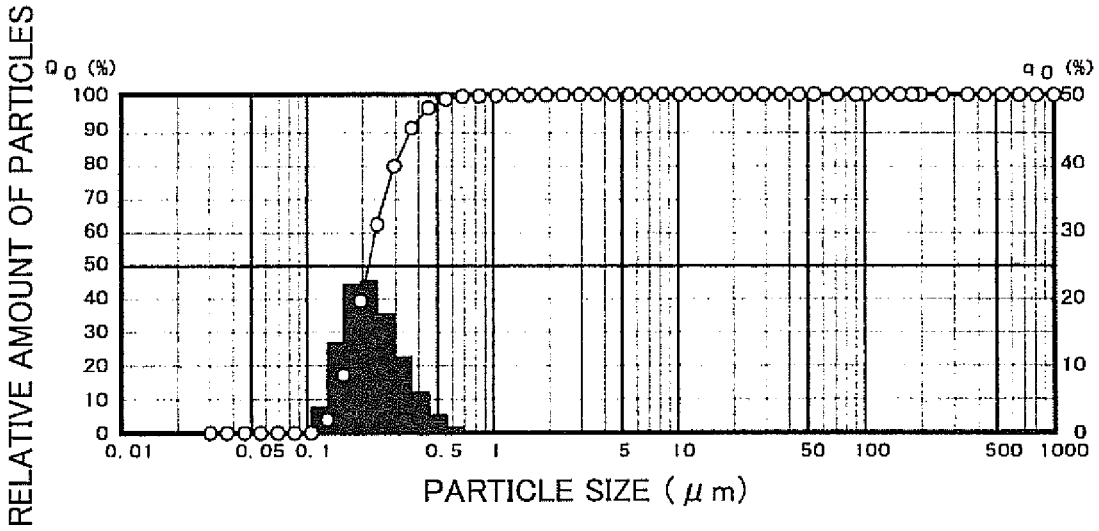
FIG. 23 is a graph showing the particle size distribution of a micro emulsion into which an oleic acid is introduced by an amount of 50 ml/min using a fluid mixer having an acute angle θ2 of 15°.

2) Micro emulsion is produced in the same manner as described above using the fluid mixer 10 where the acute angle θ2 is set to 15°. The particle size distribution of the micro emulsion is shown in FIG. 23. It is confirmed from FIG. 23 that relatively homogenized emulsion having a peak in particle size at approximately 0.178 μm (mode size) is produced.

Figure 24:
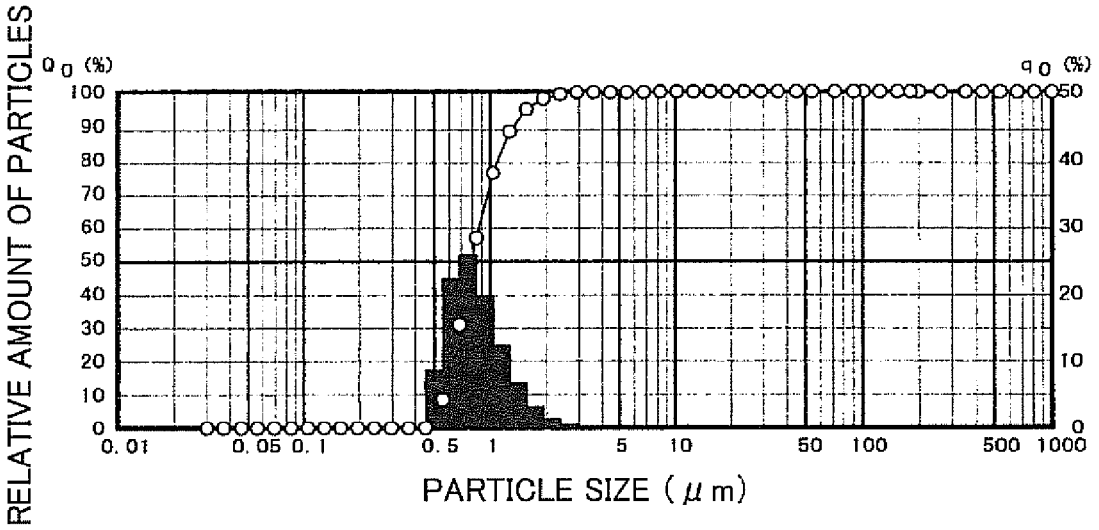
FIG. 24 is a graph showing particle size distribution of a micro emulsion into which oleic acid is introduced by 50 ml/min using a fluid mixer having an acute angle θ2 of 30°.

3) Using the fluid mixer 10 where the acute angle θ2 is set to 30°, micro emulsion is produced in the same manner as described above. The particle size distribution of the micro emulsion is shown in FIG. 24. It is confirmed from FIG. 24 that relatively homogenized emulsion having a peak in particle size at approximately 0.708 μm (mode size) is produced.

Based on the above-mentioned results, it is confirmed that the fluid mixer 10 according to this embodiment is suitable for a micro emulsion technique. It is also confirmed that a mode size is decreased and made more uniform in the descending order of the acute angle, that is, in the order of 30°, 24° and 15°. It is understood that, the changing of the acute angle θ2 influences a mode size of the first fluid F1 which forms a dispersion phase. That is, it is understood that a particle size of the first fluid F1 can be controlled to some extent by changing the acute angle θ2.

Next, to consider the application of the present invention to the actual industry, time efficiency in production of micro emulsion becomes important. As factors which largely influence time efficiency in production of micro emulsion, an amount of introduced (emulsified) oil and a suction pump pressure are named. These factors are studied hereinafter.

Amount of Introduced Oil (Oleic Acid)

Figure 25:
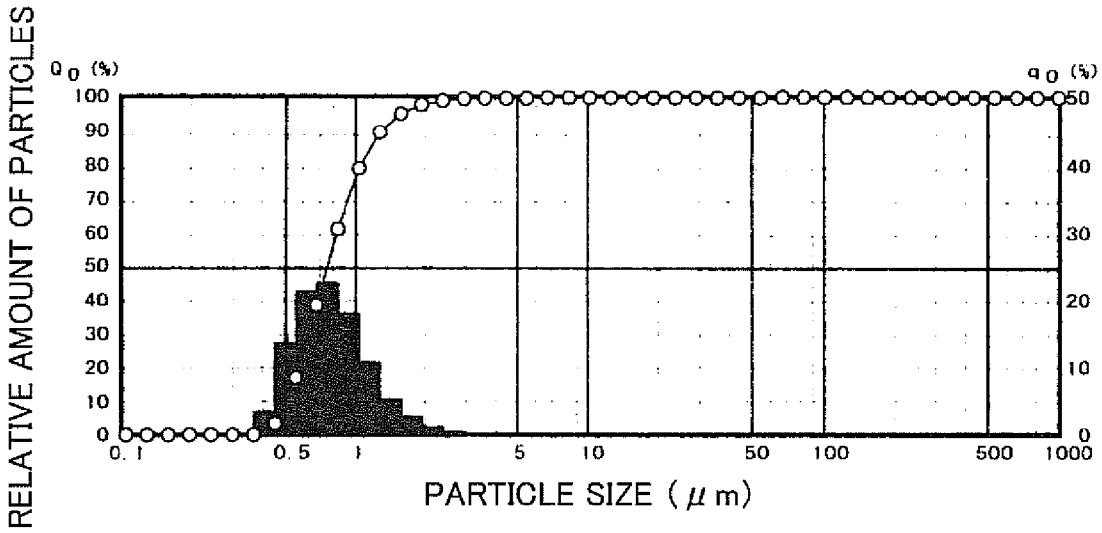
FIG. 25 is a graph showing the particle size distribution of a micro emulsion into which an oleic acid is introduced by an amount of 100 ml/min.

FIG. 25 is a graph showing the result of measurement of particle size distribution which is performed under a condition that an amount of introduced oil (oleic acid) is increased to 100 ml/min from 50 ml/min. It is confirmed from FIG. 25 that the particle size approximately equal to the particle size shown in FIG. 22 is obtained. Although an introducing amount of oleic acid is increased to 130 ml/min, a large change is not confirmed in the particle size distribution.

On the other hand, it is confirmed that the number of particles is increased corresponding to an introduced amount of oil.

Pump Pressure

A suction pump pressure depends on a flow rate and hence, the pump pressure is evaluated based on a total flow rate using two kinds of suction pumps P under an environment where conditions such as diameters and lengths of the fluid mixer 10 and the pipes (first communication pipe 3 and the second communication pipe 5) are equal except for the suction pumps P (flow rate: 16 l/min and 23 l/min).

Figure 26:
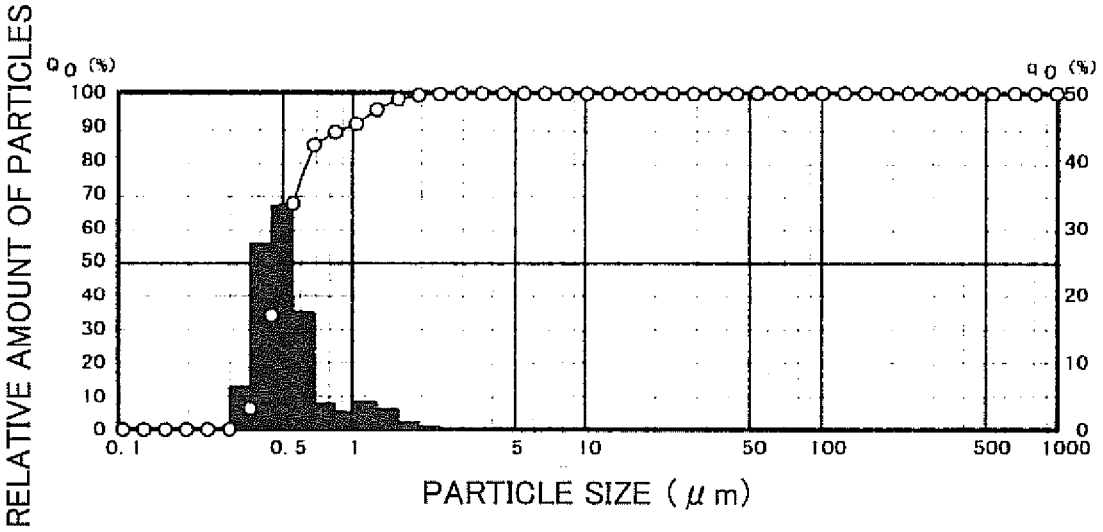
FIG. 26 is a graph showing the particle size distribution of a micro emulsion at a flow rate of 23 l/min.

FIG. 26 shows the particle size distribution when an introduced amount of oleic acid is 50 ml/min and a flow rate of produced micro emulsion is 23 l/min. The peak of the particle size becomes approximately 0.5 μm which is smaller than the peak of particle size shown in FIG. 22. It is considered that this result is brought about by a fact that although the total flow rate is increased, an amount of introduced oleic acid is fixed and hence, only water (dispersion solvent) which is introduced simultaneously with oleic acid is increased, that is, a rate of amount of water which constitutes the dispersion solvent is increased with respect to the emulsified oleic acid and hence, an oleic-acid swirl dispersion force is enhanced.

On the other hand, it is confirmed that the number of particles is controlled by only an amount of introduced oleic acid when either pump (total flow rate) is used (see FIG. 27).

Influence Exerted by Viscosity of Introduced Oil

Figure 29:
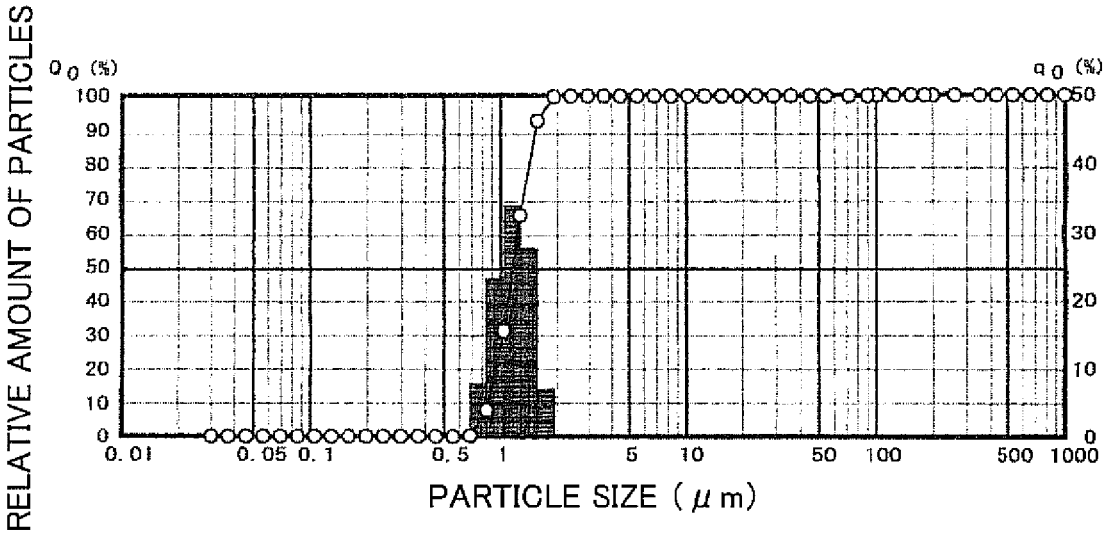
FIG. 29 is a graph showing the particle size distribution of a micro emulsion produced using water and soybean oil.
Figure 30:
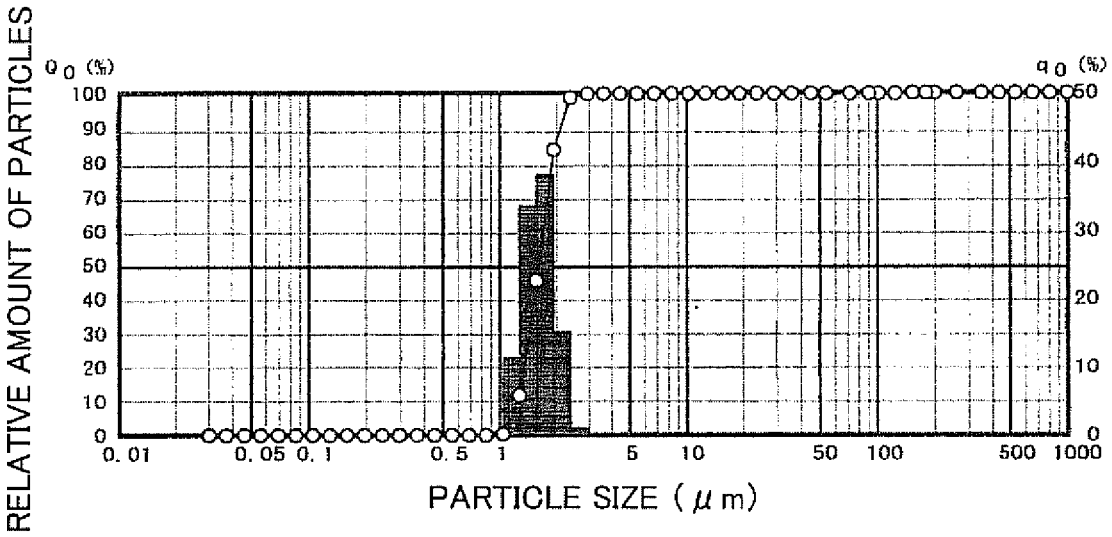
FIG. 30 is a graph showing the particle size distribution of a micro emulsion produced using water and rapeseed oil.
Figure 31:
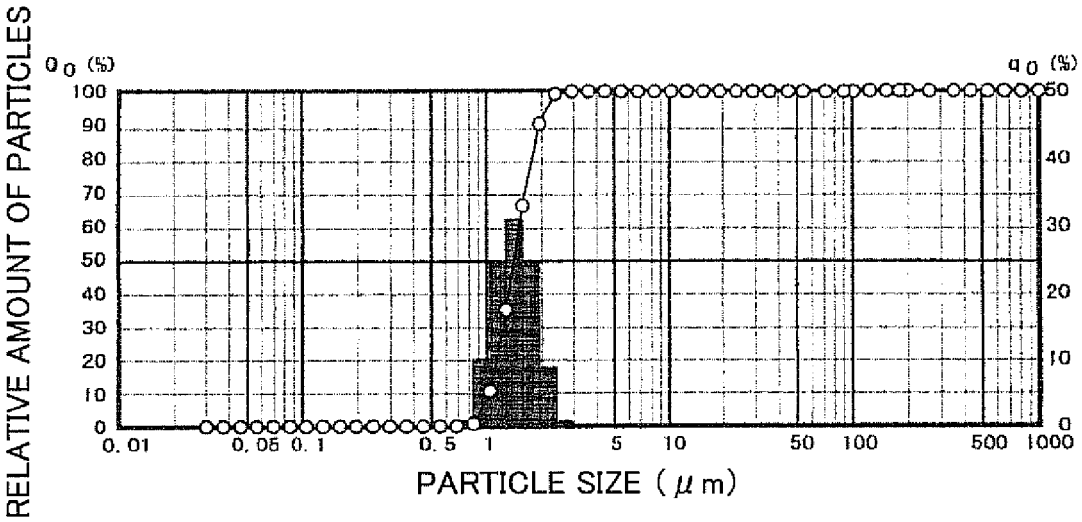
FIG. 31 is a graph showing the particle size distribution of micro emulsion produced using water and corn oil.
Figure 32:
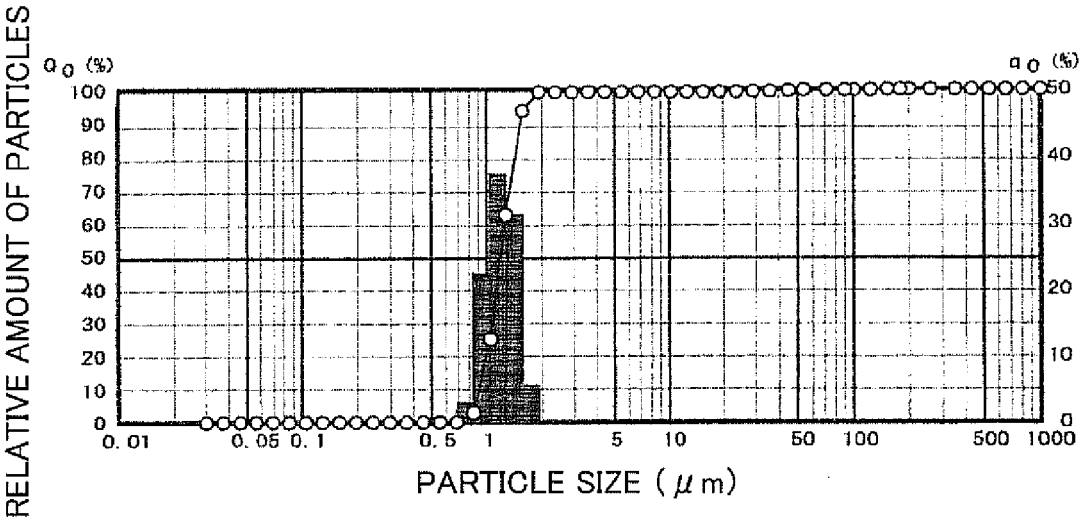
FIG. 32 is a graph showing the particle size distribution of micro emulsion produced using water and olive oil.
Figure 33:
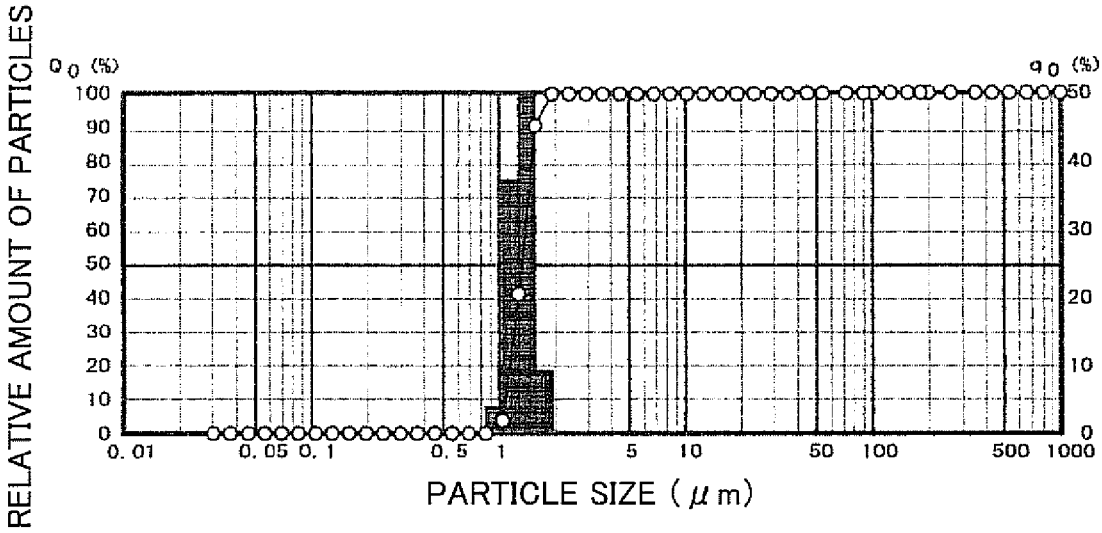
FIG. 33 is a graph showing the particle size distribution of micro emulsion produced using water and camellia oil.

When a fluid in a liquid phase and a fluid in a liquid phase are emulsified into micro emulsion by making use of a swirl mixed flow, a particle size and the like are more influenced by physiochemical elements than the compositions of the solutions. According to the experiment carried out in the example 3, viscosity of introduced oil is particularly evaluated. An average particle size and the number of particles which are confirmed in the measurement of viscosities and particle size distributions of various oils used in this embodiment are respectively shown in FIG. 28. Further, as examples of the measurement of particle size distribution, FIG. 29 shows a measurement result when soybean oil is used, FIG. 30 shows a measurement result when rapeseed oil is used, FIG. 31 shows a measurement result when corn oil is used, FIG. 32 shows a measurement result when olive oil is used, and FIG. 33 shows a measurement result when camellia oil is used.

It is confirmed that the viscosity of oil hardly influences the average particle size, the number of particles and the like, and the particle size is controlled by a suction pump pressure, and the number of particles is controlled by an amount of introduced oil based on results including the result on the above-mentioned item, that is, oleic acid and introduced oil (oleic acid).

Stability

Figure 34:
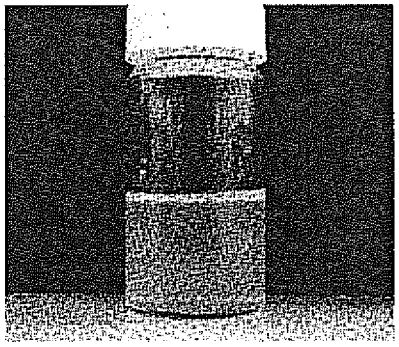
FIG. 34 is a photograph of micro-emulsified camellia oil (immediately after processing).
Figure 35:
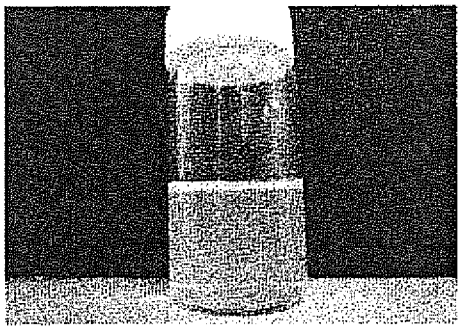
FIG. 35 is a photograph showing micro-emulsified camellia oil after a lapse of three months (being left for three months after processing).

FIG. 34 shows a state of micro-emulsified camellia oil (immediately after processing), and FIG. 35 shows a state of micro-emulsified camellia oil after three months elapse (left after processing for three months). It is confirmed that stable micro emulsion is produced without using an emulsifying agent such as a surfactant.

CONCLUSION

The micro-emulsifying technique which uses the fluid mixing device 1 is studied. As a result of the study, it is confirmed that the average particle size, the number of particles and the like of the produced emulsion are hardly influenced by the viscosity of the emulsion, and the particle size is controlled by a suction pump pressure, and the number of particles is controlled by an amount of introduced fluid.

EXPLANATION OF SYMBOLS

1: fluid mixing device
2: second fluid storing portion
3: first communication pipe
4: first fluid storing portion
7: mixed fluid storing portion
10: fluid mixer
11: mixer body
12: opening portion at one end
13: opening portion at the other end
14: axial flow path
15: hole formed in the body for introducing fluid
16: proximal-end-side cylindrical portion
17: distal-end-side cylindrical portion
17*a*: one-side edge portion
18: distal-end cylindrical portion
19: spiral flow passage
30: cover member
34: cover body
34*a*: one-side edge portion

The invention claimed is:

1. A fluid mixer, comprising:

a cylindrical mixer body, having an opening portion on both ends thereof; forms therein, the following:

an axial flow path in which a first fluid introduced into the axial flow path through the opening portion at one end is made to flow therethrough in an axial direction and the first fluid is made to exit from the opening portion at the other end;

a spiral flow path in which a second fluid introduced into the spiral flow path through a hole for introducing fluid into the mixer body formed in a peripheral wall of the mixer body is made to flow along an inner peripheral surface of the mixer body while being swirled in a spiral manner about an axis of the axial flow path so that the first fluid and the second fluid are mixed with each other and a mixture formed of the first fluid and the second fluid is made to exit from the opening potion at the other end;

an outer periphery of the mixer body is covered with a cover member with a predetermined gap maintained therebetween;

a swirl flow path is formed in the inside of the cover member such that the second fluid introduced into the inside of the cover member through a hole for introducing fluid into the cover member formed in a peripheral wall of the cover member is made to flow along an inner peripheral surface of the cover member while being swirled about the axis of the axial flow path; and the second fluid is introduced into the hole for introducing fluid into the mixer body formed in the mixer body;

the first fluid which axially flows through the axial flow path and the second fluid which forms a swirl flow in a spiral manner around the first fluid are mixed with each other over a whole region of the spiral flow path, and a mixture of the first fluid and the second fluid is made to exit from the opening portion at the other end; and the mixer body including:

a proximal-end-side cylindrical portion which is formed with a diameter thereof gradually increasing toward the opening portion at the other end through the opening portion at one end;

a distal-end-side cylindrical portion which is formed with the approximately same diameter from a terminal end of the proximal-end-side cylindrical portion to the opening portion at the other end;

a plurality of slit-like holes operable for introducing a fluid into the mixer body and which extend with a predetermined acute angle with respect to a longitudinal direction are formed in a peripheral wall of the distal-end-side cylindrical portion; and the respective holes for introducing fluid into the mixer body are arranged at intervals along a single spiral in the extending direction thereof.

2. The fluid mixer, according to claim 1, wherein:

a slit-like hole operable for introducing a fluid into the cover member which extends along the longitudinal direction of the cover member is formed in a peripheral wall of the cover member.

3. A fluid mixing method, comprising the steps of:

providing a fluid mixer defining an axial direction, the fluid mixer comprising:

a cylindrical mixer body, having an opening portion on both ends thereof, forms therein, the following:

an axial flow path in which a first fluid introduced into the axial flow path through the opening portion at one end is made to flow therethrough in an axial direction and the first fluid is made to exit from the opening portion at the other end; and a spiral flow path in which a second fluid introduced into the spiral flow path through a hole for introducing fluid into the mixer body formed in a peripheral wall of the mixer body is made to flow along an inner peripheral surface of the mixer body while being swirled in a spiral manner about an axis of the axial flow path so that the first fluid and the second fluid are mixed with each other and a mixture formed of the first fluid and the second fluid is made to exit from the opening potion at the other end;

flowing the first fluid which flows through the axial flow path along the axial direction of the axial flow path;

flowing the second fluid which forms a swirl flow through a swirl flow path and, thereafter, forms a swirl flow in a spiral manner through a spiral flow path on an outer periphery of the first fluid; and mixing said first fluid and said second fluid with each other while being made to flow in the axial direction of the axial flow path;

wherein an outer periphery of the mixer body is covered with a cover member with a predetermined gap maintained therebetween;

a swirl flow path is formed in the inside of the cover member such that the second fluid introduced into the inside of the cover member through a hole for introducing fluid into the cover member formed in a peripheral wall of the cover member is made to flow along an inner peripheral surface of the cover member while being swirled about the axis of the axial flow path; and the second fluid is introduced into the hole for introducing fluid into the mixer body formed in the mixer body;

the first fluid which axially flows through the axial flow path and the second fluid which forms a swirl flow in a spiral manner around the first fluid are mixed with each other over a whole region of the spiral flow path, and a mixture of the first fluid and the second fluid is made to exit from the opening portion at the other end; and wherein, the mixer body includes:

a proximal-end-side cylindrical portion which is formed with a diameter thereof gradually increasing toward the opening portion at the other end through the opening portion at one end;

a distal-end-side cylindrical portion which is formed with the approximately same diameter from a terminal end of the proximal-end-side cylindrical portion to the opening portion at the other end;

a plurality of slit-like holes operable for introducing a fluid into the mixer body and which extend with a predetermined acute angle with respect to a longitudinal direction are formed in a peripheral wall of the distal-end-side cylindrical portion; and the respective holes for introducing fluid into the mixer body are arranged at intervals along a single spiral in the extending direction thereof.

4. A fluid mixing method, comprising the steps of:

providing a fluid mixer defining an axial direction, the fluid mixer comprising:

a cylindrical mixer body, having an opening portion on both ends thereof, forms therein, the following:

an axial flow path in which a first fluid introduced into the axial flow path through the opening portion at one end is made to flow therethrough in an axial direction and the first fluid is made to exit from the opening portion at the other end; and a spiral flow path in which a second fluid introduced into the spiral flow path through a hole for introducing fluid into the mixer body formed in a peripheral wall of the mixer body is made to flow along an inner peripheral surface of the mixer body while being swirled in a spiral manner about an axis of the axial flow path so that the first fluid and the second fluid are mixed with each other and a mixture formed of the first fluid and the second fluid is made to exit from the opening potion at the other end;

flowing the first fluid which flows through the axial flow path along the axial direction of the axial flow path;

flowing the second fluid which forms a swirl flow through a swirl flow path and, thereafter, forms a swirl flow in a spiral manner through a spiral flow path on an outer periphery of the first fluid; and mixing said first fluid and said second fluid with each other while being made to flow in the axial direction of the axial flow path; and wherein, the mixer body includes:

a proximal-end-side cylindrical portion which is formed with a diameter thereof gradually increasing toward the opening portion at the other end through the opening portion at one end;

a distal-end-side cylindrical portion which is formed with the approximately same diameter from a terminal end of the proximal-end-side cylindrical portion to the opening portion at the other end;

a plurality of slit-like holes operable for introducing a fluid into the mixer body and which extend with a predetermined acute angle with respect to a longitudinal direction are formed in a peripheral wall of the distal-end-side cylindrical portion; and the respective holes for introducing fluid into the mixer body are arranged at intervals along a single spiral in the extending direction thereof.

5. The fluid mixing method, according to claim 4, further comprising the steps of:

providing a vessel for storing the second fluid therein;

flowing, in the inside of the vessel which stores the second fluid therein, the first fluid along the axial direction in the axial flow path and reducing a pressure in the axial flow path and thereby sucking the second fluid stored in the vessel into the axial flow path and forming a swirl flow in a spiral manner in the axial direction of the axial flow path.

6. A fluid mixer, comprising:

a cylindrical mixer body, having an opening portion on both ends thereof; forms therein, the following:

an axial flow path in which a first fluid introduced into the axial flow path through the opening portion at one end is made to flow therethrough in an axial direction and the first fluid is made to exit from the opening portion at the other end;

a spiral flow path in which a second fluid introduced into the spiral flow path through a hole for introducing fluid into the mixer body formed in a peripheral wall of the mixer body is made to flow along an inner peripheral surface of the mixer body while being swirled in a spiral manner about an axis of the axial flow path so that the first fluid and the second fluid are mixed with each other and a mixture formed of the first fluid and the second fluid is made to exit from the opening potion at the other end; and the mixer body includes:

a proximal-end-side cylindrical portion which is formed with a diameter thereof gradually increasing toward the opening portion at the other end through the opening portion at one end;

a distal-end-side cylindrical portion which is formed with the approximately same diameter from a terminal end of the proximal-end-side cylindrical portion to the opening portion at the other end;

a plurality of slit-like holes operable for introducing a fluid into the mixer body and which extend with a predetermined acute angle with respect to a longitudinal direction are formed in a peripheral wall of the distal-end-side cylindrical portion; and the respective holes for introducing fluid into the mixer body are arranged at intervals along a single spiral in the extending direction thereof.

7. The fluid mixer, according to claim 6, wherein:

a slit-like hole operable for introducing a fluid into the cover member which extends along the longitudinal direction of the cover member is formed in a peripheral wall of the cover member.

8. The fluid mixing method, according to claim 3, wherein:

a slit-like hole operable for introducing a fluid into the cover member which extends along the longitudinal direction of the cover member is formed in a peripheral wall of the cover member.

9. The fluid mixing method, according to claim 3, further comprising the steps of:

providing a vessel for storing the second fluid therein;

flowing, in the inside of the vessel which stores the second fluid therein, the first fluid along the axial direction in the axial flow path and reducing a pressure in the axial flow path and thereby sucking the second fluid stored in the vessel into the axial flow path and forming a swirl flow in a spiral manner in the axial direction of the axial flow path.

* * * * *